US006094489A

United States Patent [19]

Ishige et al.

[11] Patent Number: 6,094,489

[45] Date of Patent: Jul. 25, 2000

[54] DIGITAL HEARING AID AND ITS HEARING SENSE COMPENSATION PROCESSING METHOD

[75] Inventors: Ryuuichi Ishige; Yukio Mitome, both of Tokyo, Japan

[73] Assignee: NEC Corporation, Tokyo, Japan

[21] Appl. No.: 08/929,771

[22] Filed: Sep. 15, 1997

[30] Foreign Application Priority Data

Sep. 13, 1996 [JP] Japan ..... 8-243254

[51] Int. Cl.[7] ..... H04R 25/00

[52] U.S. Cl. ..... 381/60; 381/312

[58] Field of Search ..... 381/60, 71.6, 312, 381/320, 321, 314

[56] References Cited

U.S. PATENT DOCUMENTS 5,838,801 11/1998 Ishige et al. ..... 381/68.4
5,852,668 12/1998 Ishige et al. ..... 381/312
5,892,836 4/1999 Ishige et al. ..... 381/316

FOREIGN PATENT DOCUMENTS 3-284000 12/1991 Japan .
8-223698 8/1996 Japan .

*Primary Examiner*—Curtis A. Kuntz
*Assistant Examiner*—Phylesha Dabney
*Attorney, Agent, or Firm*—Sughrue, Mion, Zinn, Macpeak & Seas, PLLC

[57] ABSTRACT

Input data are analyzed by FFT, etc. in an analyzing section and power every frequency band is calculated and sent to a control section. In a gain control section, changing characteristics of a gain used in the control section are calculated on the basis of hearing ability characteristics of a user obtained from a memory section and a gain setting memory section, a sound pressure for starting a reduction in gain, and a sound pressure for setting the gain to be equal to or greater than 0 dB. The calculated changing characteristics are sent to the control section. In the control section, the gain every frequency band required in a hearing sense compensating section is determined on the basis of analyzed results obtained from the analyzing section, the hearing ability characteristics of the user obtained from the memory section, and the changing characteristics of the gain obtained from the gain control section. The control section sends data of the gain to the hearing sense compensating section. The hearing sense compensating section obtaining the input data and the gain data performs hearing sense compensation processing with respect to the input data and sends the processed input data to an output section.

14 Claims, 19 Drawing Sheets

1 : INTERMEDIATE HEARABLE VALUE OF NORMAL HEARING

DIGITAL HEARING AID AND ITS HEARING SENSE COMPENSATION PROCESSING METHOD

BACKGROUND OF THE INVENTION

1. Field of the Invention

The present invention relates to a digital hearing aid and its hearing sense compensation processing method using digital signal processing with a sound sensing hearing impairment as an object.

2. Description of the Related Art

A hearing sense lesion, i.e., hearing impairment can be conventionally mainly divided into two kinds of a sound transmitting hearing impairment and a sound sensing hearing impairment. The sound transmitting hearing impairment is a hearing sense lesion caused by a change in sound transmitting characteristics since a certain lesion is caused in one or all of an external ear, a middle ear, a round window and an oval window. The sound transmitting hearing impairment can be overcome by simply amplifying an input sound.

In contrast to this, the sound sensing hearing impairments is a hearing sense lesion in which it is considered that there is an organic disease lesion in a portion from the middle ear to a cortical auditory area. The sound sensing hearing impairment shows a state in which it is difficult to sense a sound itself by abnormality of the middle ear, etc.

The sound sensing hearing impairment is caused since there is no stereocilia at an end tip of a hair cell of a cochlea and there are a lesion of a nerve for transmitting a voice, etc. Presbycusis is included in this sound sensing hearing impairment.

It is difficult to overcome the sound sensing hearing impairment by a hearing aid constructed by only a conventional simple amplifier. Recently, a digital hearing aid capable of performing complicated signal processing has begun to be noted. An individual difference is various and large with respect to symptoms of the sound sensing hearing impairment. There is a recruitment phenomenon of a loudness as one of the main symptoms. A sound pressure is a physical quantity of a sound and the loudness is a sound amount sensed when a human being hears a sound at a certain sound pressure, i.e., a sensing amount.

In the recruitment phenomenon, as shown in FIG. 1, an audible minimum level (a minimum hearable value, HTL) is raised and no maximum level (maximum hearable value, UCL) is changed so much and a hearable range (auditory area) is narrowed in comparison with a normal hearing person. The maximum hearable value is slightly reduced in many cases. Namely, a small sound is inaudible and a large sound can be heard at a loudness as in the normal hearing person in this phenomenon. Therefore, when the small sound is amplified to hear the small sound by a hearing aid, etc. and the large sound is inputted, an output sound exceeds a maximum hearable value so that the large sound attains an uncomfortable level and is inaudible. Therefore, it is necessary to amplify the small sound with a large gain and amplify the large sound with a small gain. One of the features of the recruitment phenomenon is also that the above changes in hearing ability are different from each other every frequency.

Countermeasures of the above sound hearing impairment are taken in the following three prior arts.

There is a technique described in Japanese Patent Application Laid Open No. 3-284000 hereinafter referred to as prior art 1. In this prior art, the dynamic range of an input sound is compressed within a narrowed hearable range of a hearing impairment person. FIGS. 2A to 2E show a hearing sense compensation processing method of a hearing aid using this method. In FIG. 2A, an axis of abscissa shows a sound pressure and an axis of ordinate shows a loudness. A curve shown by a solid line shows the relation of the sound pressure and the loudness with respect to a normal hearing person. A curve shown by a broken line shows the relation of the sound pressure and the loudness with respect to the hearing impairment person. As can be seen from FIG. 2A, when the normal hearing person and the hearing impairment person hear a sound at a certain sound pressure, the normal hearing person senses this sound as a large sound in comparison with the hearing impairment person. When the heard sound pressure is set to be smaller than that at a minimum hearable threshold value of the hearing impairment person, no hearing impairment person can hear this sound although the normal hearing person can hear this sound.

A solid line of FIG. 2B shows the relation of a sound pressure sensed as an equal loudness by the above normal hearing person and the hearing impairment person. Axes of ordinate and abscissa of FIG. 2B respectively show a sound pressure level with respect to the hearing impairment person and a sound pressure level with respect to the normal hearing person. The difference between sounds sensed as the same loudness by the hearing impairment person and the normal hearing person is increased as the sound pressure is reduced. This difference is reduced as the sound pressure is increased. Here, a broken line shows that a straight line relation at a large sound pressure level is extrapolated until a sound pressure level 0 as it is. This broken line also shows the relation of a sound pressure level provided when normal hearing persons are compared with each other. The relation of the sound pressure shown by this broken line is shown by a straight line. In FIG. 2B, when the sound pressure level with respect to the normal hearing person is considered as an input and the sound pressure level with respect to the hearing impairment person is considered as an output, the relation shown by a solid line of FIG. 2C is obtained. A broken line of FIG. 2C shows the relation of input and output levels when these input and output levels are equal to each other. When the hearing aid amplifies an input sound with the difference between solid and broken lines of FIG. 2C as a gain, the hearing impairment person can sense the input sound as a sound having the same loudness as the normal hearing person.

FIG. 2D shows the relation between a gain calculated as mentioned above and an input sound pressure. When the input sound pressure is reduced, the gain is increased. The gain is reduced as the input sound pressure is increased.

FIG. 2E is a view conceptually showing a calculating method of the gain of the hearing aid calculated from loudness curves of the normal hearing person and the hearing impairment person and an intensity (sound pressure level) of the input sound. In FIG. 2E, an axis of ordinate shows a loudness level [phon] and an axis of abscissa shows a sound pressure level [dB] of the input sound. A solid line in FIG. 2E shows a loudness curve of the normal hearing person and a one-dotted chain line shows a loudness curve of the hearing impairment person.

FIG. 2E is a graph of a loudness curve showing the loudness of an input sound heard by each of the normal hearing person and the hearing impairment person. In FIG. 2E, an axis of abscissa shows a sound pressure level (dB) and an axis of ordinate shows a loudness (phon). The axes of ordinate and abscissa of FIG. 2E are shown by logarithm. As shown in FIG. 2E, the normal hearing person hears a sound heard at a loudness c' as a sound at a sound pressure c, and the hearing impairment person hears a sound heard at the loudness c' as a sound at a sound pressure c". Namely, when the hearing impairment person hears the sound at the sound pressure c by amplifying this sound until the sound pressure c", the hearing impairment person hears the sound at the same loudness as the sound at the sound pressure c heard by the normal hearing person. The gain of the hearing aid shows that the above sound pressure c is amplified to the sound pressure c". The loudness curve shown in FIG. 2E is shown by logarithm on both the axes of ordinate and abscissa. Therefore, the gain G is calculated from the following formula 1.

$$G=c''-c \quad (1)$$

Here, c" shows a sound intensity heard by the hearing impairment person and c shows the intensity of an input sound. It is known from the formula 1 that the gain is increased as the difference between c" and c is increased.

There is a thesis entitled "Consideration of a hearing impairment person hearing system by noise suppression processing and automatic gain control" hereinafter referred to as prior art 2. This thesis is described on page 415 of a lecture thesis collection of a meeting for reading research papers in Acoustic Society of Japan, in spring, 1996. FIG. 3 is a block diagram showing the construction of this hearing impairment person hearing system.

In this construction, an input sound is first linearly estimated and analyzed (LPC analyzed) in a voice/non-voice discriminating section 1 so that spectral inclusive characteristics and an estimate residual signal are obtained. Next, a correlation of this residual signal is calculated. If a peak value of this residual signal is equal to or greater than a threshold value, this signal is set to a signal in a voice section. In contrast to this, if the peak value is equal to or smaller than the threshold value, this signal is set to a signal in a non-voice section. The voice section shows a signal and the non-voice section shows a noise.

Next, FFT (Fast Fourier Transform) 3 is performed with respect to an input signal and weighting 4 is performed by a function calculated from spectrums of the non-voice section and the voice section with respect to a spectrum of a portion discriminated as a noise in a noise suppression processing section 2. The weighted spectrum is then subtracted from a spectrum of the input signal so that noise suppression processing is performed.

Next, an inverse FFT 5 is performed with respect to the noise suppression processed signal and the obtained data are sent to an automatic gain control section (AGC section) 6. A compression/extension section 7 of the automatic gain control section 6 compresses and extends this signal. In compressing and extending methods of this compression/extension section 7, a compression threshold value 9 is first updated from an executing value 8 of a portion discriminated as a non-voice. When the executing value 8 of the noise suppression processed input signal is equal to or greater than the threshold value 9, the input signal is compressed. In contrast to this, when the executing value 8 is equal to or smaller than the threshold value, the input signal is extended. Thus, emphasis of a residual noise left in erasure of the noise suppression processing section 2 is prevented.

An average value 10 of the executing value equal to or greater than the threshold value for past several seconds is calculated to make a gentle gain adjustment and the compression/extension section 7 performs the compression and extension processes with respect to this average value 10. The automatic gain control section 6 multiplies a compression extension rate and a gain 11 by an input frame provided after the noise suppression processing, and outputs the multiplied results.

There is a thesis entitled "Development of multi-signal processing type digital hearing aid" hereinafter referred to as prior art 3. This thesis is described on pages 519 and 520 of a lecture thesis collection of a meeting for reading research papers in Acoustic Society of Japan, in autumn, 1994. FIGS. 4A and 4B show a dynamic range compressing method used in this thesis. In FIG. 4A, an axis of abscissa shows a sound pressure level of an input signal, and an axis of ordinate shows a sound pressure level of an output signal. In FIG. 4A, parameters on the axes of ordinate and abscissa in FIG. 2B are changed and are shown in a unit HL. HL is a unit with respect to a hearing ability level and shows the difference in level between a reference minimum hearable value and an output sound pressure within a prescribed coupler of an earphone for an audiometer at a certain frequency. Here, an intermediate hearable value is an intermediate value between lower and upper limit levels judged as "just good" by a tested person. Here, two kinds of dynamic range compressing methods are used.

One of the dynamic range compressing methods is a loudness compensating method in which a voice band is divided into 3ch and a nonlinear amplifying operation is performed in conformity with hearing ability characteristics of the hearing impairment person. Namely, the loudness compensating method is a method for compressing a dynamic range of the normal hearing person to a dynamic range of the hearing impairment person. This method is shown by a solid line in the graph of input and output sound pressure levels in FIG. 4A.

The other of the dynamic range compressing methods is a voice dynamic range mapping method in which the dynamic range is compressed such that 20 dBHL corresponds to a minimum hearable value of the hearing impairment person. This method is shown by a broken line in the graph of input and output sound pressure levels in FIG. 4A.

This method is shown by the graph of FIG. 4B showing the relation of the sound pressure and the loudness. As can be seen from FIG. 4B, the inclination of a straight line approximate to a loudness curve of the normal hearing person is changed.

However, these prior arts have the following defects. Namely, in the case of the prior art 1, the gain with respect to an input sound is increased as a sound pressure level is reduced. As a result, a circumferential small noise not to be originally heard is amplified with a very large gain. Accordingly, the input sound obtained by hearing sense compensation processing includes the noise amplified with a very large gain in a non-voice portion. Therefore, it is difficult for a user to hear a subsequent voice by masking in a time direction.

In the case of the prior art 2, no hearing ability characteristics of the hearing impairment person greatly different from each other every individual are considered. As a result, there is a case in which the gain of a high sound portion is too small and the gain of a low sound portion is too large with respect to a person having low hearing ability in a high sound. As a result, no sound can be heard in the high sound portion by insufficient amplification and the gain exceeds a maximum hearable value in the low sound portion so that no sound can be heard. A reverse phenomenon can be caused with respect to a person having low hearing ability in a low sound.

In the case of the prior art 3, no input sound equal to or smaller than 20 dBHL is amplified and only an input sound equal to or greater than 20 dBHL is amplified in conformity with a loudness of the input sound. Therefore, a gain with respect to the input sound slightly exceeding 20 dBHL becomes maximum. As a result, the input sound slightly exceeding 20 dBHL is amplified with a very large gain so that an output sound becomes a sound brokenly heard and having large noises and difficult to be heard.

SUMMARY OF THE INVENTION

An object of the present invention is to provide a hearing aid and its hearing sense compensating method in which a sound can be amplified in conformity with hearing ability characteristics of a hearing impairment person using a hearing aid and a sound easily heard by a user can be outputted.

A first digital hearing aid according to the present invention comprises a hearing sense compensation processing section of a dynamic range compression type for determining a gain every frequency band by using a sound pressure level of an input sound and hearing ability characteristics of a user. This hearing sense compensation processing section gradually reduces a gain with respect to the input sound at a sound pressure equal to or smaller than a preset sound pressure by using loudness curves of a normal hearing person and the user in accordance with the sound pressure of the input sound.

A second digital hearing aid according to the present invention is characterized in that the gain with respect to the input sound in the first digital hearing aid is gradually reduced by connecting a loudness level of the user equal to a loudness level sensed by the normal hearing person to a set value between minimum hearable values of the normal hearing person and the user by a straight line with respect to an input signal at a sound pressure equal to or smaller than a set sound pressure.

A third digital hearing aid according to the present invention is characterized in that the gain with respect to the input sound in the first digital hearing aid is gradually reduced by connecting a loudness level of the user equal to a loudness level sensed by the normal hearing person to a set value between minimum hearable values of the normal hearing person and the user by a downward convex curve with respect to an input signal at a sound pressure equal to or smaller than a set sound pressure. Further, the third digital hearing aid is characterized in that the change in gain is smoothed and an abnormal sound sensed by a sudden change in gain is restrained since the downward convex curve is used.

A fourth digital hearing aid according to the present invention is characterized in that the gain with respect to the input sound in the first hearing aid is gradually reduced by connecting a loudness level of the user equal to a loudness level sensed by the normal hearing person to a set value between minimum hearable values of the normal hearing person and the user by an upward convex curve with respect to a signal at a sound pressure equal to or smaller than a set sound pressure.

A fifth digital hearing aid according to the present invention is characterized in that a reduced portion of the gain with respect to the input sound in the fourth hearing aid is smoothly connected by a downward convex curve so as to smooth the change in gain.

A sixth digital hearing aid according to the present invention is characterized in that a modified function of a function approximating the loudness curve of a hearing impairment person is held in a memory section in the first, second, third, fourth or fifth hearing aid and the gain is calculated from the loudness curves of the normal hearing person and the hearing impairment person held by the memory section.

A seventh digital hearing aid according to the present invention is characterized in that the first, second, third, fourth or fifth hearing aid has a set sound pressure control section for controlling a sound pressure for starting the reduction in gain and a sound pressure for setting the gain to be equal to or greater than 0 dB, and the user can control said sound pressure level by a controller of a volume, etc.

An eighth digital hearing aid according to the present invention is characterized in that the first, second, third, fourth, fifth or sixth hearing aid has a set sound pressure memory section and, when there is no input sound to be heard by the user, the sound pressure level of the input sound at that time is stored to said set sound pressure memory section by pushing a switch, etc., and a sound pressure level set by a gain control section is controlled on the basis of a value of the sound pressure level of the input sound.

A first hearing sense compensation processing method according to the present invention is a hearing sense compensation processing method of a dynamic range compression type, wherein a gain of every frequency band is determined by using a sound pressure level of an input sound and hearing ability characteristics of a user. The gain with respect to the input sound at a sound pressure equal to or smaller than a preset sound pressure is gradually reduced by using loudness curves of a normal hearing person and the user in accordance with the sound pressure of the input sound.

A second hearing sense compensation processing method according to the present invention is characterized in that the gain with respect to the input sound in the first method is gradually reduced by connecting a loudness level of the user equal to a loudness level sensed by the normal hearing person to a set value between minimum hearable values of the normal hearing person and the user by a straight line with respect to an input signal at a sound pressure equal to or smaller than a set sound pressure.

A third hearing sense compensation processing method according to the present invention is characterized in that the gain with respect to the input sound in the first method is gradually reduced by connecting a loudness level of the user equal to a loudness level sensed by the normal hearing person to a set value between minimum hearable values of the normal hearing person and the user by a downward convex curve with respect to a signal at a sound pressure equal to or smaller than a set sound pressure. Further, the third hearing sense compensation processing method is characterized in that the change in gain is smoothed and an abnormal sound sensed by a sudden change in gain is restrained since the downward convex curve is used.

A fourth hearing sense compensation processing method according to the present invention is characterized in that the gain with respect to the input sound in the first method is gradually reduced by connecting a loudness level of the user equal to a loudness level sensed by the normal hearing person to a set value between minimum hearable values of the normal hearing person and the user by an upward convex curve with respect to a signal at a sound pressure equal to or smaller than a set sound pressure.

A fifth hearing sense compensation processing method according to the present invention is characterized in that a reduced portion of the gain with respect to the input sound in the fourth method is smoothly connected by a downward convex curve so as to smooth the change in gain.

Effects of the first method in the present invention relate to problems of the hearing sense compensation processing method in which the gain with respect to the input sound at a sound pressure equal to or smaller than a certain constant sound pressure is set to 0 dB and the gain with respect to the input sound at a sound pressure equal to or greater than this constant sound pressure is increased as the input sound is reduced. An amplification factor of a small noise is reduced to solve a phenomenon in which the gain with respect to an input sound slightly exceeding the above certain constant value becomes maximum, and the above input sound is amplified with a very large gain, and noises in non-voice portions before and after a voice are particularly greatly amplified and it is difficult to sufficiently hear the voice by masking in a time direction. Thus, it is possible to improve the masking in the time direction for the noises in the non-voice portions before and after the input voice in the hearing sense compensation processing method.

In effects of the first hearing aid in the present invention, no gain with respect to a small input sound becomes maximum and the gain with respect to the input sound at a sound pressure equal to or smaller than a set value is reduced as the input sound is reduced. Thus, it is possible to improve that no output voice can be easily heard by the masking in the time direction.

In effects of the second method in the present invention, in addition to the effects of the first method, calculating processing relative to the calculation of the gain can be reduced by calculating the gain with respect to the input sound at a sound pressure equal to or smaller than a certain constant sound pressure from a straight line on a loudness curve.

In effects of the second hearing aid in the present invention, in addition to the effects of the first hearing aid, calculating processing relative to the calculation of the gain can be reduced by calculating the gain with respect to the input sound at a sound pressure equal to or smaller than a certain constant sound pressure from a straight line on a loudness curve.

In effects of the third method in the present invention, in addition to the effects of the first method, the gain with respect to the input sound at a sound pressure equal to or smaller than a preset sound pressure is calculated from a downward convex curve by a graph of the loudness curve so that a change in gain with respect to the input sound at a sound pressure level close to the above set sound pressure is smoothed and an abnormal sound sensed by a sudden change in gain can be restrained.

In effects of the third hearing aid in the present invention, in addition to the effects of the first hearing aid, the gain with respect to the input sound at a sound pressure equal to or smaller than a preset sound pressure is calculated from a downward convex curve by a graph of the loudness curve so that a change in gain with respect to the input sound at a sound pressure level close to the above set sound pressure is smoothed and an abnormal sound caused by a sudden change in gain can be restrained.

In effects of the fourth method in the present invention, in addition to the effects of the first method, the gain with respect to the input sound at a sound pressure equal to or smaller than a preset sound pressure is calculated from an upward convex curve by a graph of the loudness curve so that the gain with respect to the input sound at a sound pressure level equal to or smaller than the above set sound pressure can be reduced as much as possible.

In effects of the fourth hearing aid in the present invention, in addition to the effects of the first hearing aid, the gain with respect to the input sound at a sound pressure equal to or smaller than a preset sound pressure is calculated from an upward convex curve by a graph of the loudness curve so that the gain with respect to the input sound at a sound pressure level equal to or smaller than the above set sound pressure can be reduced as much as possible.

In effects of the fifth method in the present invention, in addition to the effects of the third method, a reduced portion of the gain with respect to the input sound is smoothed by a downward convex curve so that the change in gain with respect to the input sound close to a sound pressure level providing the reduced gain is smoothed and an abnormal sound sensed by a sudden change in gain can be restrained.

In effects of the fifth hearing aid in the present invention, in addition to the effects of the fourth hearing aid, a reduced portion of the gain with respect to the input sound is smoothed by a downward convex curve so that the change in gain with respect to the input sound close to a sound pressure level providing the reduced gain is smoothed and an abnormal sound sensed by a sudden change in gain can be restrained.

In effects of the sixth hearing aid in the present invention, in addition to the effects of the first to fifth hearing aids, a modifying work of the loudness curve of a hearing impairment person is made at a fitting time and all required data are held in the memory section so that an entire calculating amount of the hearing aid can be greatly reduced.

In effects of the seventh hearing aid in the present invention, in addition to the effects of the first to fifth hearing aids, the hearing aid has the set sound pressure control section for controlling a sound pressure for starting the reduction in gain so that a user can control the above sound pressure level by a controller of a volume, etc., and can reduce the gain with respect to a small noise, or the gain with respect to a small input sound.

In effects of the eighth hearing aid in the present invention, a gain control coefficient memory section is arranged in addition to the effects of the first to fifth and seventh hearing aids. Accordingly, when there is no input sound to be heard by the user, the sound pressure level of the input sound at that time is stored to the above gain control coefficient memory section by pushing a switch, etc., and the set sound pressure control section sets a sound pressure level for starting the reduction in gain on the basis of a value of the sound pressure level of the input sound. Therefore, it is possible to suitably set the gain used in the hearing sense compensation processing in various environments.

DESCRIPTION OF THE PREFERRED EMBODIMENTS

Figure 1:
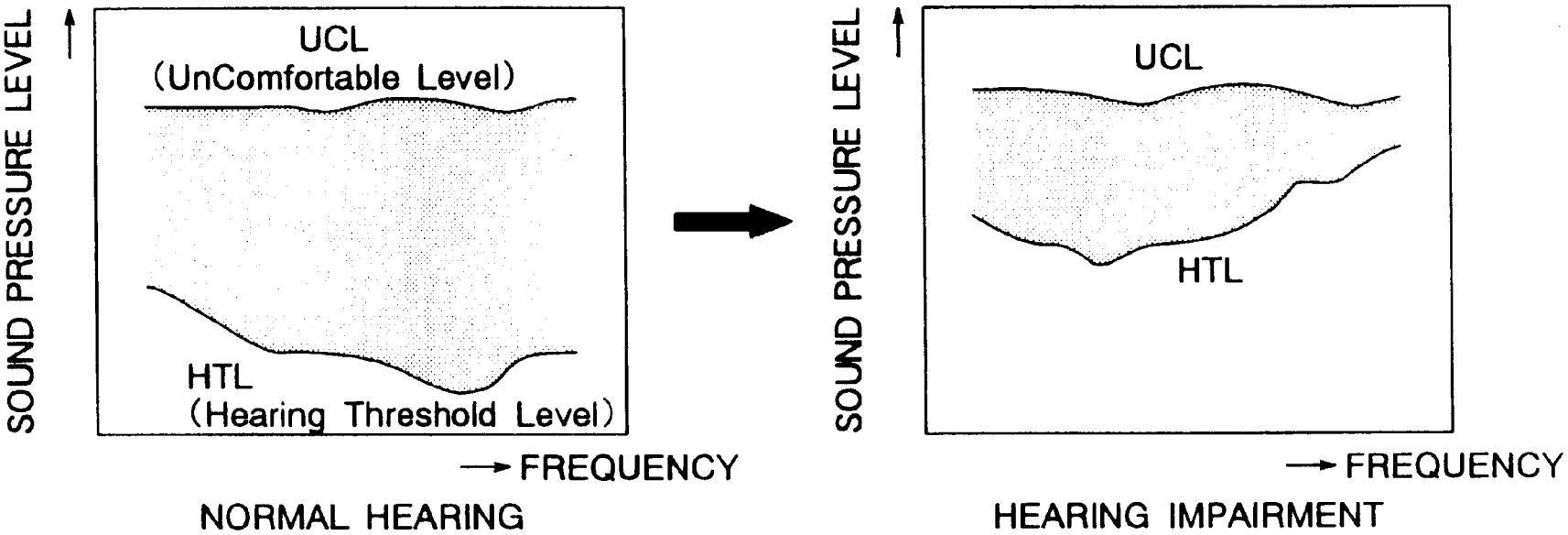
FIG. 1 PRIOR ART
FIG. 1 is a conceptual view of a sound sensing hearing impairment.
Figure 2A:
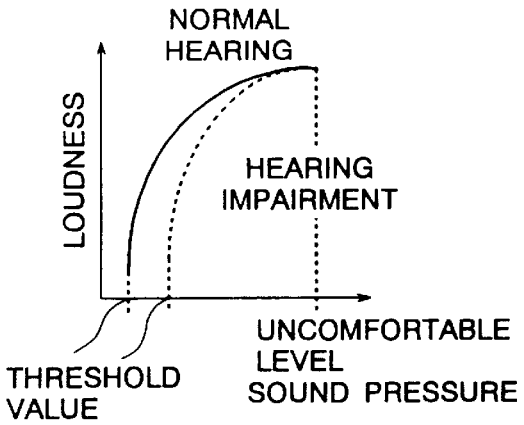
FIG. 2A PRIOR ART
FIGS. 2A to 2E are graphs showing an example 1 of the prior art.
Figure 2B:
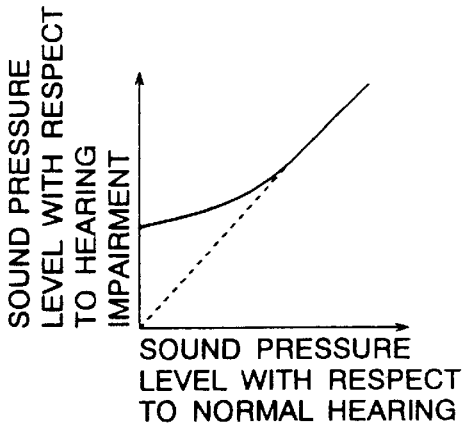
FIG. 2B PRIOR ART
Figure 2C:
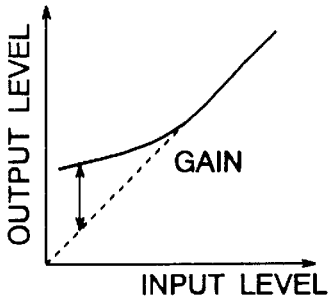
FIG. 2C PRIOR ART
Figure 2D:
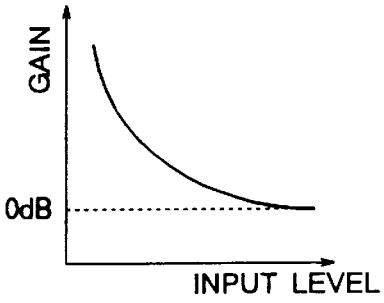
FIG. 2D PRIOR ART
Figure 2E:
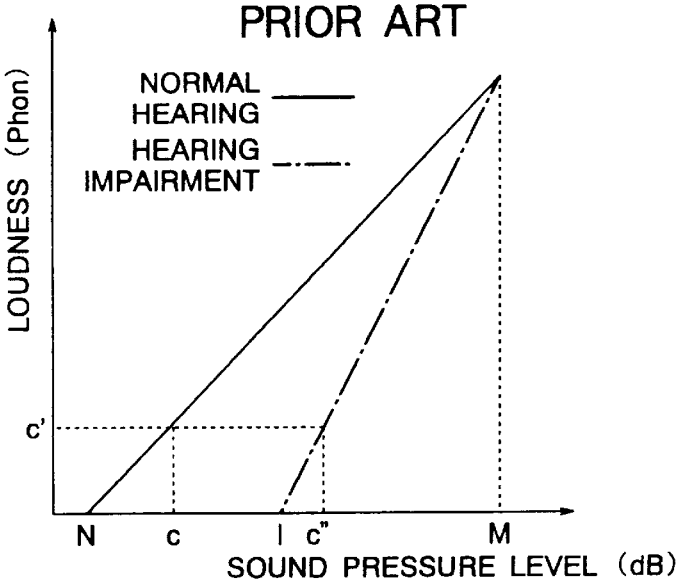
FIG. 2E PRIOR ART
Figure 3:
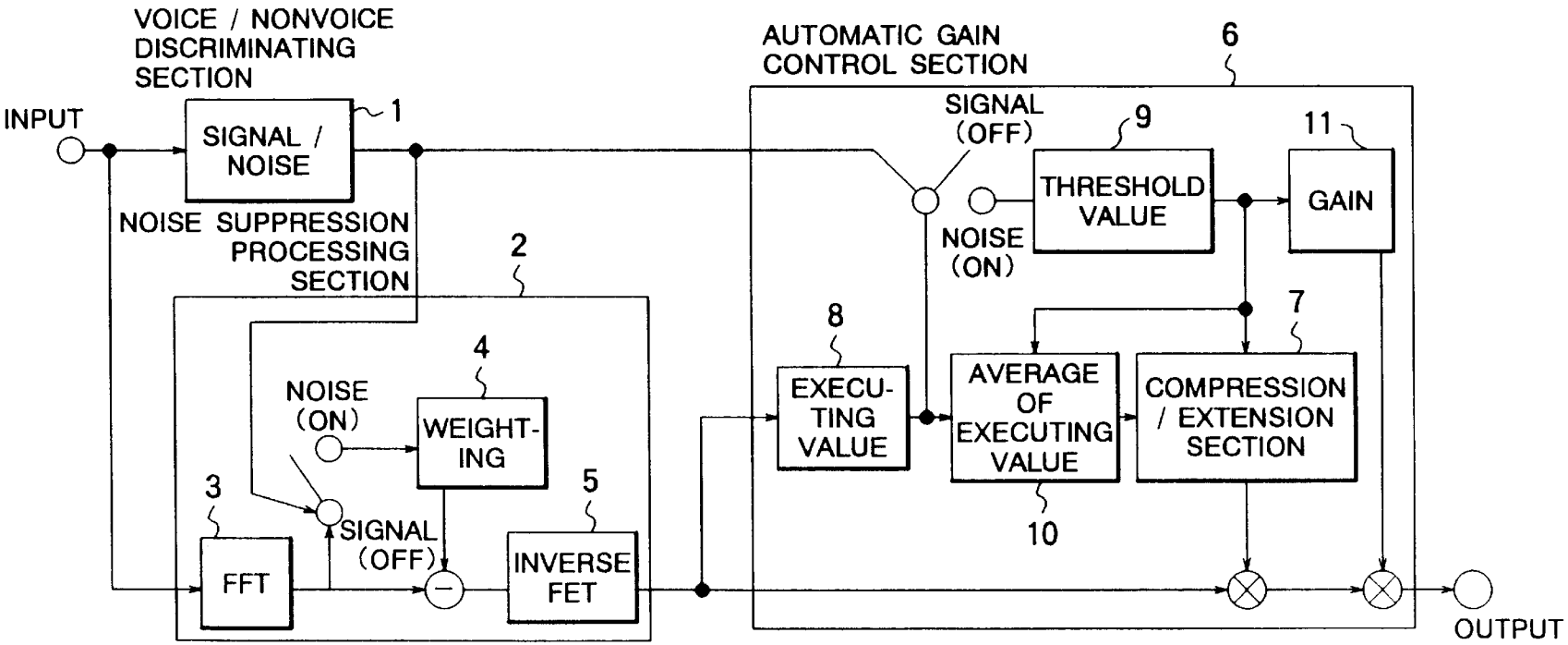
FIG. 3 PRIOR ART
FIG. 3 is a block diagram showing an example 2 of the prior art.
Figure 4A:
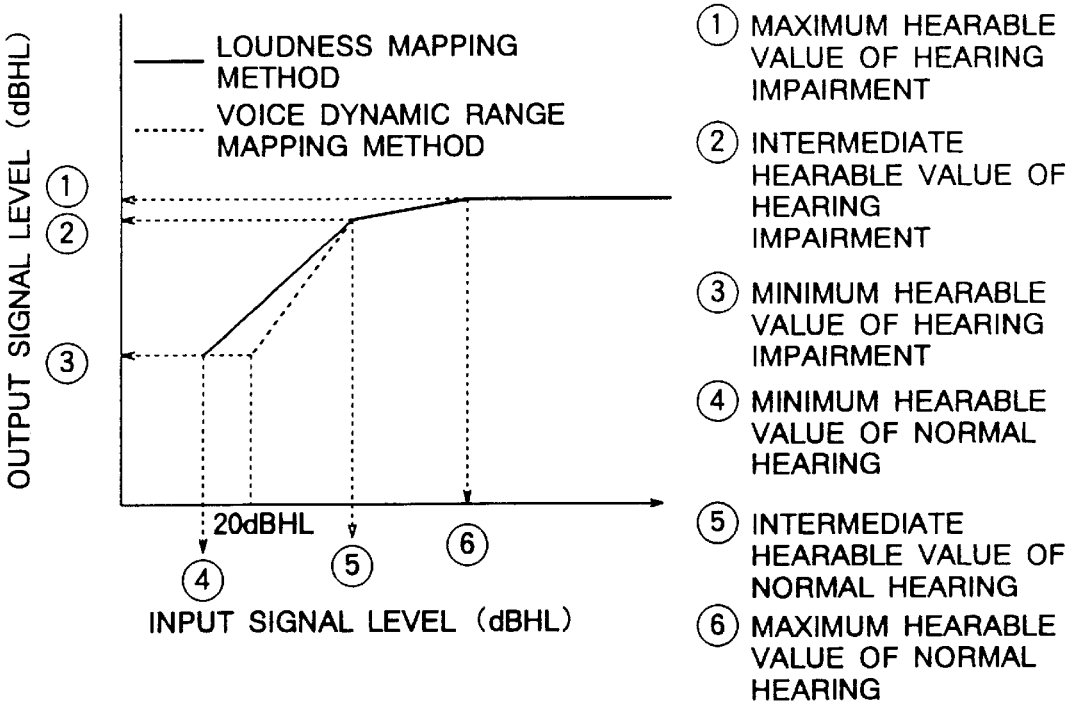
FIG. 4A PRIOR ART
FIGS. 4A to 4B are graphs showing an example 3 of the prior art.
Figure 4B:
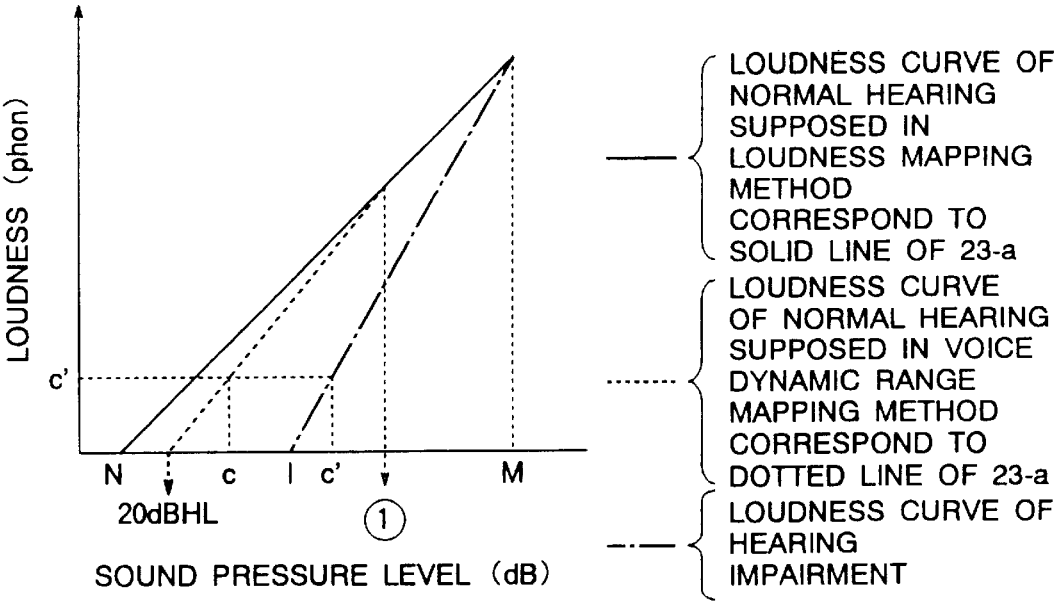
FIG. 4B PRIOR ART
Figure 5:
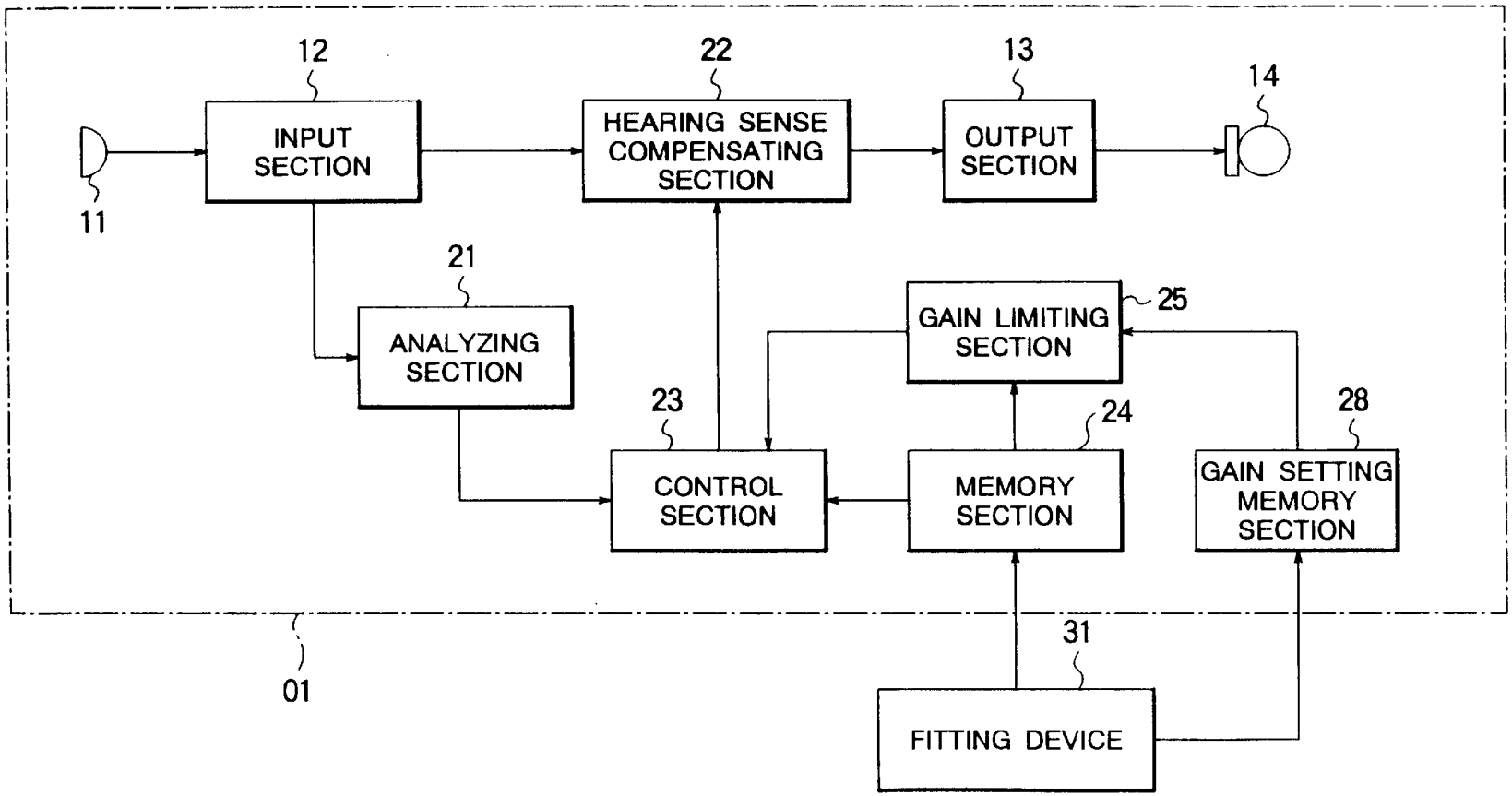
FIG. 5 is a block diagram showing a hearing aid in accordance with an embodiment of the present invention.

FIG. 5 is a block diagram showing the construction of a digital hearing aid in accordance with an embodiment of the present invention. FIG. 5 shows a common construction of first to eighth digital hearing aids of the present invention.

The hearing aid in the present invention is applied to the user of a sound sensing hearing impairment. Therefore, in hearing sense compensation processing, an input sound must be compressed to an auditory area of the user narrowed in comparison with a normal hearing person such that a small input sound is amplified with a large gain and a large input sound is amplified with a small gain. Similar to hearing ability characteristics of the user, changing characteristics of the gain used in the hearing sense compensation processing are different from each other every frequency band and the gain is determined by an intensity of the input sound and the hearing ability characteristics of the user. However, in this method, the gain with respect to the small input sound becomes maximum and an output sound is provided by amplifying small noises very greatly. Therefore, the present invention is characterized in that no gain with respect to the input sound having a sound pressure equal to or smaller than a preset sound pressure is increased.

In the following description, the above preset sound pressure is set to a sound pressure level at which the gain begins to be reduced. In a hearing aid 01, the hearing ability characteristics of the user are stored by a fitting device 31 to a memory section 24 in advance. A sound pressure level for starting the reduction in gain and a sound pressure level for setting the gain to be equal to or greater than 0 dB are simultaneously stored to a gain setting memory section 28. An input sound inputted by a microphone 11 is converted to digital data (hereinafter set to input data) by an input section 12.

The input data are buffered in the input section 12 in accordance with necessity and are sent to a hearing sense compensating section 22 and an analyzing section 21.

In the analyzing section 21, the input data are analyzed by FFT (Fast Fourier Transform), etc., and power every frequency band is calculated (hereinafter set to analyzed results). The analyzed results are sent to a control section 23.

In a gain limiting section (gain control section) 25, the change characteristics of the gain used in the control section 23 are calculated on the basis of the hearing ability characteristics of the user obtained from the memory section 24 and the gain setting memory section 28, the sound pressure for starting the reduction in gain, and the sound pressure for setting the gain to be equal to or greater than 0 dB. The calculated changing characteristics are sent to the control section 23. In the control section 23, the gain every frequency band required in the hearing sense compensating section 22 is determined on the basis of the analyzed results obtained from the analyzing section 21, the hearing ability characteristics of the user obtained from the memory section 24, and the changing characteristics of the gain obtained from the gain limiting section 25. Data of the determined gain are sent to the hearing sense compensating section 22. The hearing sense compensating section 22 obtaining the input data and the gain data performs the hearing sense compensation processing with respect to the input data and sends the processed input data to an output section 13.

In the output section 13, the processed data are converted to analog data and are outputted as a sound from an earphone 14.

Figure 6:
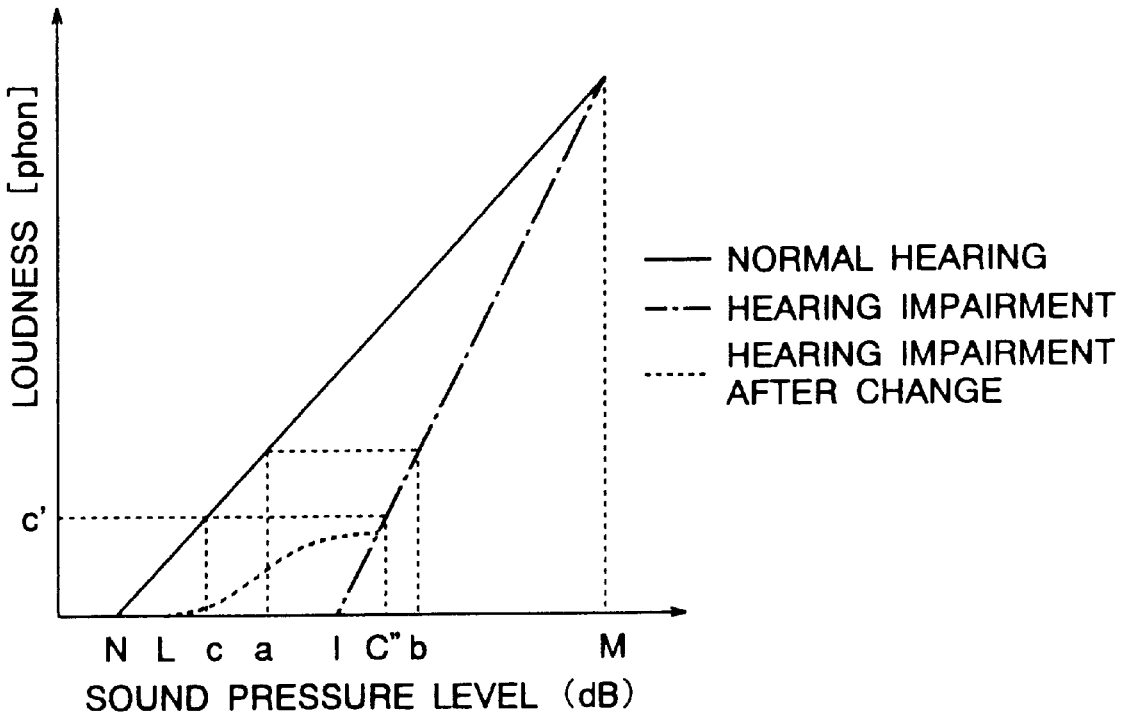
FIG. 6 is a graph of a loudness curve in a first embodiment of the present invention.

A hearing sense compensation processing method in the first embodiment will next be explained by using FIGS. 6 and 7. The relation between a loudness shown by phon and an input sound pressure shown by dB from hearing ability data of a normal hearing person and a hearing impairment person is approximated by an increasing function. This increasing function is provided by approximating a loudness curve of each of the normal hearing person and the hearing impairment person. FIG. 6 shows an example of the function approximating this loudness curve. In FIG. 6, an axis of abscissa shows an input sound pressure [dB] and an axis of ordinate shows a loudness [phon]. The gain of the hearing sense compensation processing section is calculated from the difference between functions approximating the loudness curves of the normal hearing person and a user, and is set to $G=b-a$ from the above formula (1) with respect to the input sound at a sound pressure a.

As can be seen from FIG. 6, the gain is increased if the sound pressure of the input sound is reduced. Therefore, an average value of the inclination of a function equal to or smaller than a point c" on a function approximating the loudness curve of the user shown by a one-dotted chain line of FIG. 6 is reduced to change a shape of this curve. If the loudness curve of the normal hearing person is approximated by a function represented by the following formula (2) and the loudness curve of the hearing impairment person is approximated by a function represented by the following formula (3), the function approximating the loudness curve of the hearing impairment person is changed as represented by the following formula (4) when Xi is equal to or smaller than the sound pressure c" in the formula (3). Namely, the function approximating the loudness curve of the hearing impairment person is represented by the formula (3) if $Xi>c''$, and is represented by the formula (4) if $Xi<c''$.

Thus, as shown by a broken line of FIG. 6, the function approximating the loudness curve of the hearing impairment person is close to the function approximating the loudness curve of the normal hearing person so that the difference between these functions is reduced.

$$Yn=An\times Xn-On \quad (2)$$

$$Yi=Ai\times Xi-Oi \quad (3)$$

$$Yi=Ai\times Xi5+Bi\times Xi4+Ci\times Xi3+Di\times Xi2+Ei\times Xi+Fi \quad (4)$$

At this time, $$c'=Ai\times C''5+Bi\times c''4+Ci\times c''3+Di\times c''2+Ei\times c''+Fi.$$

Thus, it is possible to reduce the gain with respect to a sound pressure level equal to or smaller than the sound pressure c".

Figure 7:
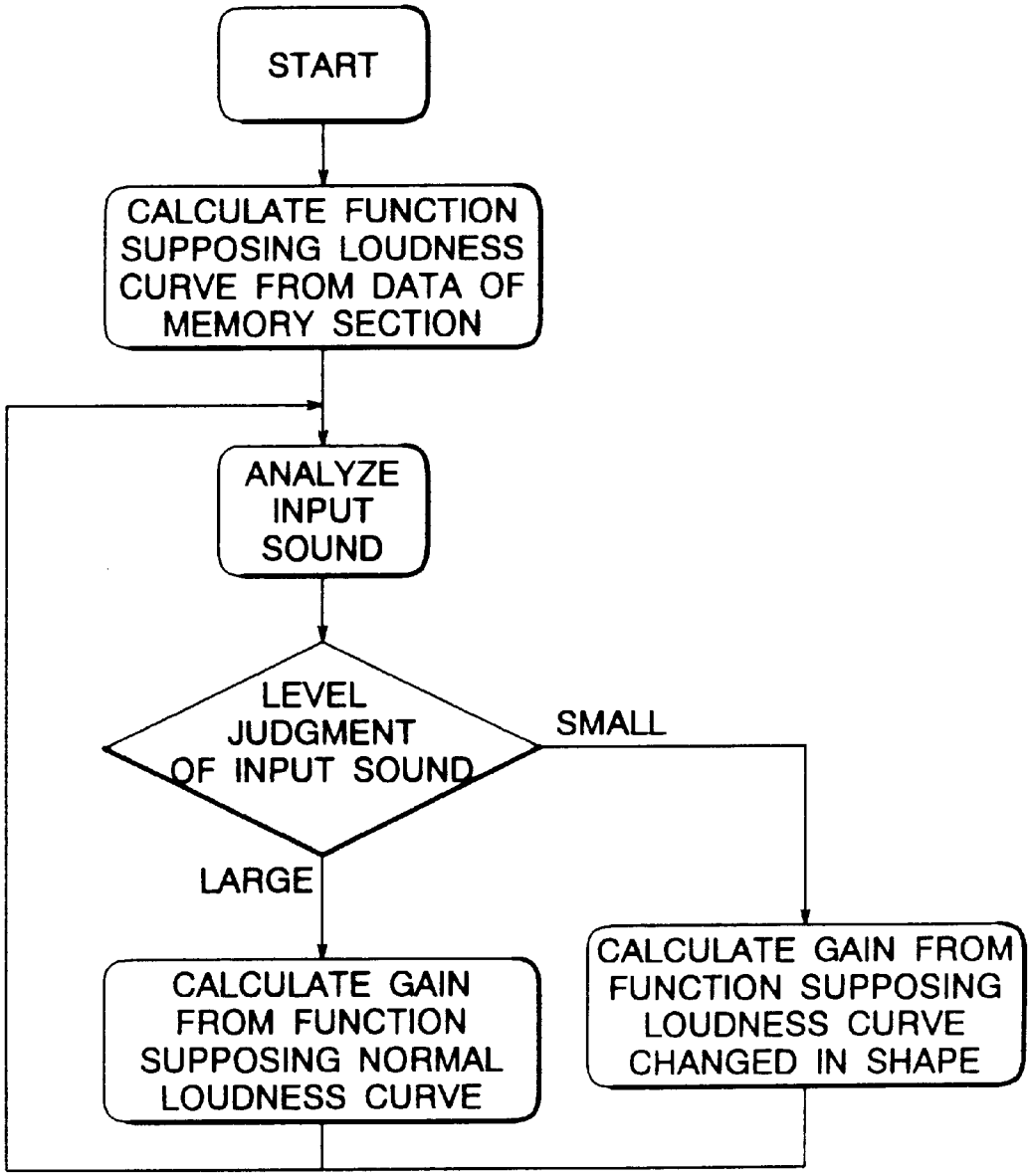
FIG. 7 is a flow chart of processing in the first embodiment of the present invention.

The processing flow so far is shown in the flow chart of FIG. 7.

First, functions approximating the loudness curves of the normal hearing person and the user are calculated from data of the memory section. These functions correspond to the formulas (2) and (3). Next, the function approximating the loudness curve of the user having a sound pressure level equal to or smaller than the sound pressure level for starting the reduction in gain is changed. In this case, it is sufficient to set an average inclination of this curve to be small. Thereafter, the sound pressure of an input sound is calculated from analyzed results of the input sound and is compared with the sound pressure level for starting the reduction in gain. If the sound pressure of the input sound is larger, the gain is calculated from the function approximating the loudness curve of the user prior to the change. Thus, when the sound pressure of the input sound is larger than a certain constant sound pressure c", the gain is increased as the input sound is reduced. In contrast to this, when the sound pressure of the input sound is smaller than the sound pressure c", the gain is reduced as the input sound is reduced. Namely, the gain with respect to a small noise is reduced and it is possible to reduce small noises of non-voice portions located before and after a voice portion among the input sound.

Figure 8:
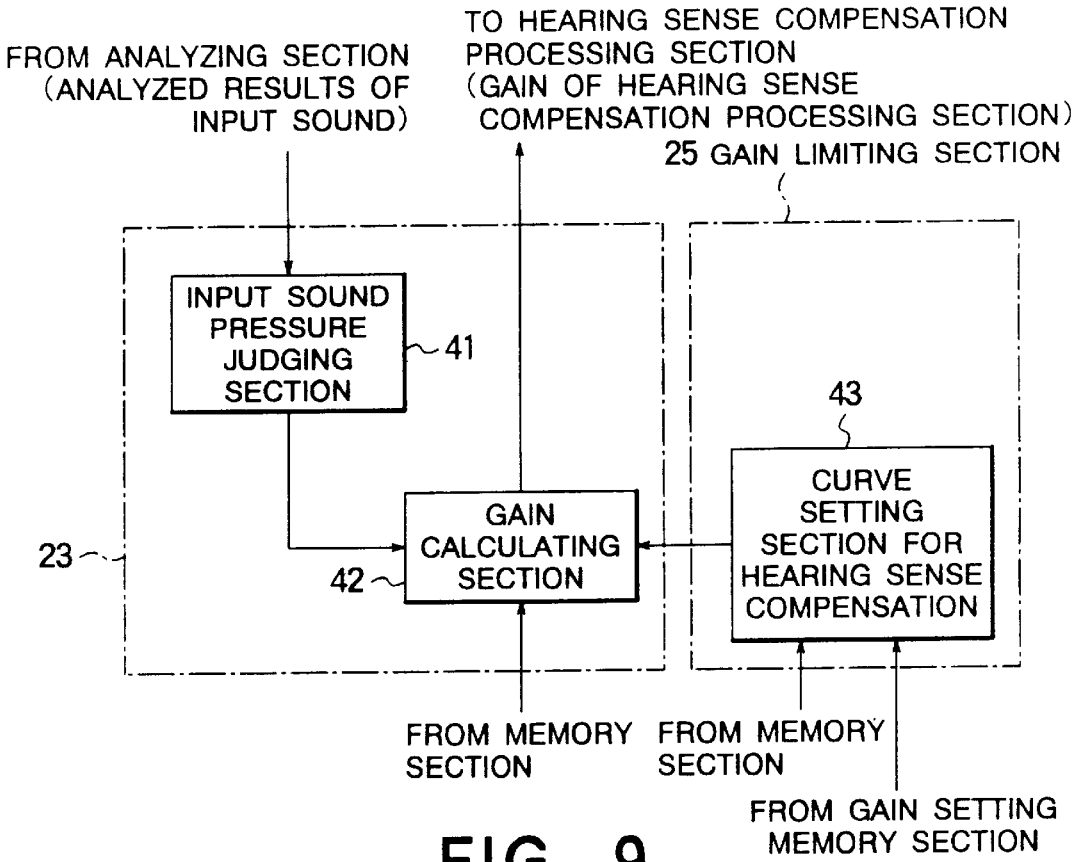
FIG. 8 is a block diagram of a hearing aid in accordance with the first embodiment of the present invention.

The hearing aid in the first embodiment will next be explained by using FIG. 8. This hearing aid is used in the hearing sense compensating method in the first embodiment. The gain used in the hearing sense compensation processing is determined in the hearing sense compensation processing in the control section 23 and the gain limiting section 25 in the block diagram of the hearing aid shown in FIG. 5. FIG. 8 shows a block diagram of this control section 23 and the gain limiting section 25. First, analyzed results of the input sound are sent from the analyzing section 21 to an input sound pressure judging section 41. The input sound pressure judging section 41 compares these analyzed results with a sound pressure level for starting the reduction in gain of the sound pressure level of the input sound. A curve setting section 43 for hearing sense compensation inputs hearing ability data of the normal hearing person and the user stored to the memory section 24 at a fitting time, the sound pressure level c" for starting the reduction in gain, and a sound pressure level L for setting the gain to be equal to or greater than 0 dB. The curve setting section 43 also calculates a function approximating a loudness curve for calculating the gain required in the hearing sense compensating section 22.

Figure 9:
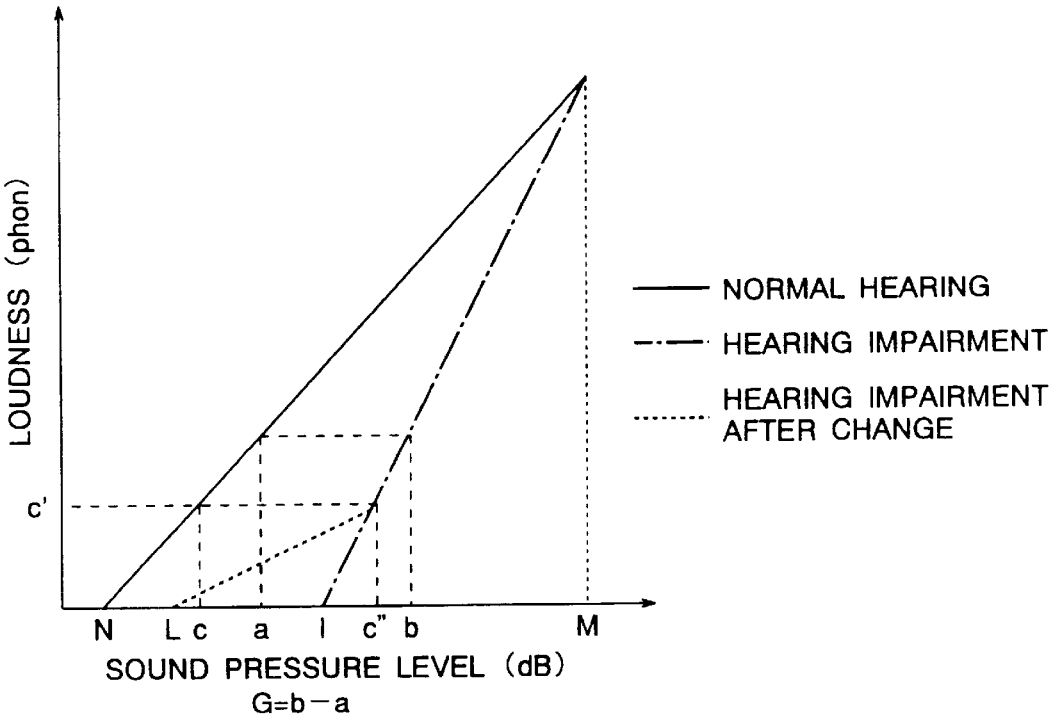
FIG. 9 is a graph of a loudness curve in a second embodiment of the present invention.

A hearing sense compensation processing method in a second embodiment of the present invention will next be explained by using FIGS. 9 and 10. In this method, the function approximating the loudness curve of the hearing impairment person having a sound pressure equal to or smaller than the sound pressure c" for starting the reduction in gain is changed by a reduction in inclination in a straight line state as shown in FIG. 9 in the processing method in the first embodiment so as to reduce the gain with respect to the input sound having a sound pressure equal to or smaller than the sound pressure c". The sound pressure L for setting the gain to be equal to or greater than 0 dB and preset to the gain setting memory section is set at a terminal end of the straight line. In the case of a sound pressure equal to or smaller than the sound pressure c", the gain is calculated from the function approximating the loudness curve of the normal hearing person represented by the formula (2) and a straight line represented by the following formula (5). In the case of a sound pressure equal to or greater than the sound pressure c", similar to the first embodiment of the present invention, the gain is calculated from the function approximating the loudness curve of the normal hearing person represented by the formula (2) and the function approximating the loudness curve of the hearing impairment person represented by the formula (3).

$$Yis=Ais\times Xis-Ois \quad (5)$$

Here, Xis of the formula (3)>Xis of the formula (5) is set.

Figure 10:
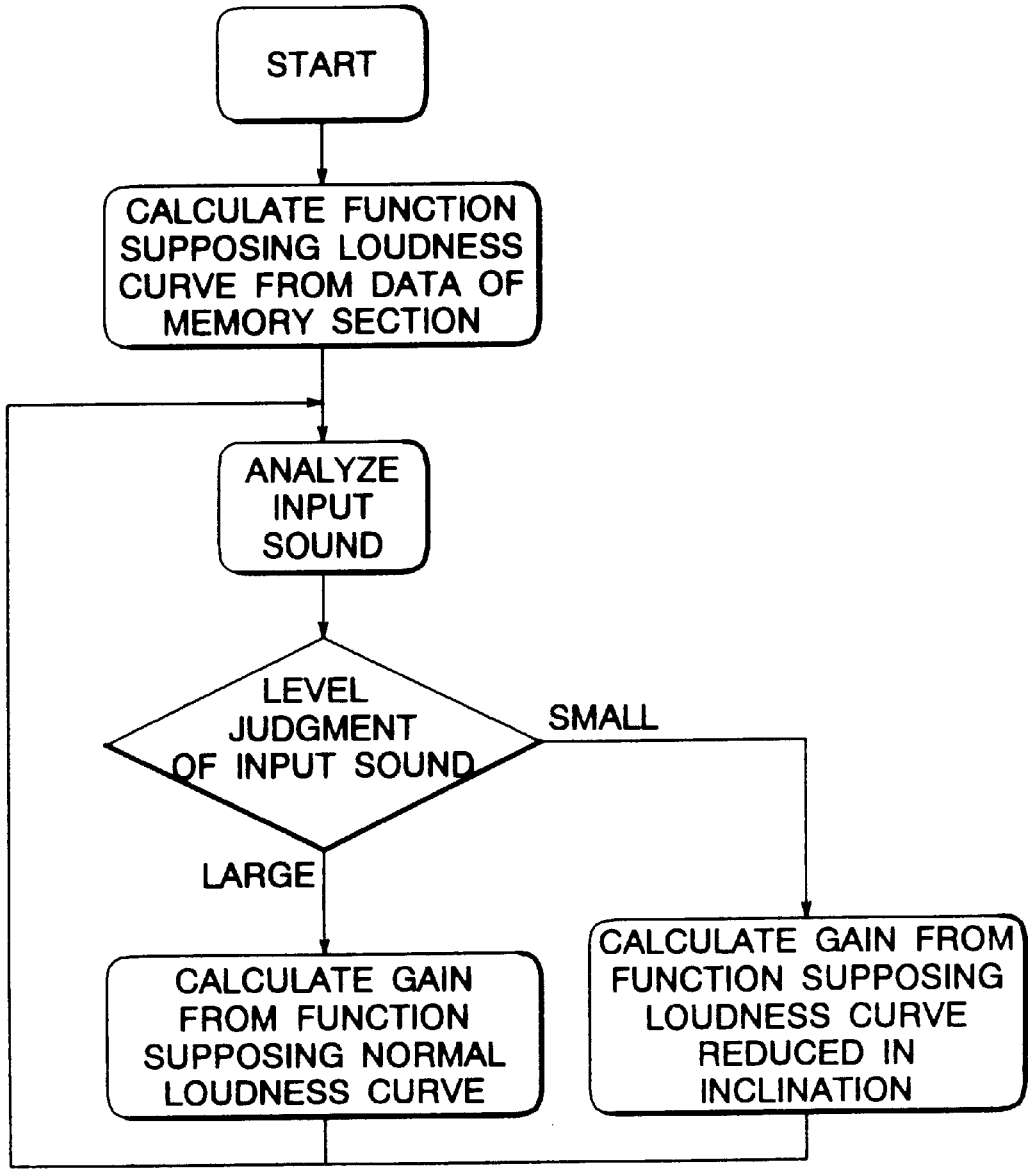
FIG. 10 is a flow chart of processing in the second embodiment of the present invention.

As can be seen from FIG. 10, after a level judgment of the input sound is made, the gain is calculated from a function approximating a loudness curve having a reduced inclination when the input sound is small in comparison with the sound pressure c" for starting the reduction in gain with respect to the input sound.

In this processing method in the second embodiment, in addition to the first processing method, calculating processing relative to the calculation of the gain can be reduced by calculating the gain with respect to the input sound at a sound pressure equal to or smaller than a preset sound pressure from a straight line on the function approximating the loudness curve.

Figure 11:
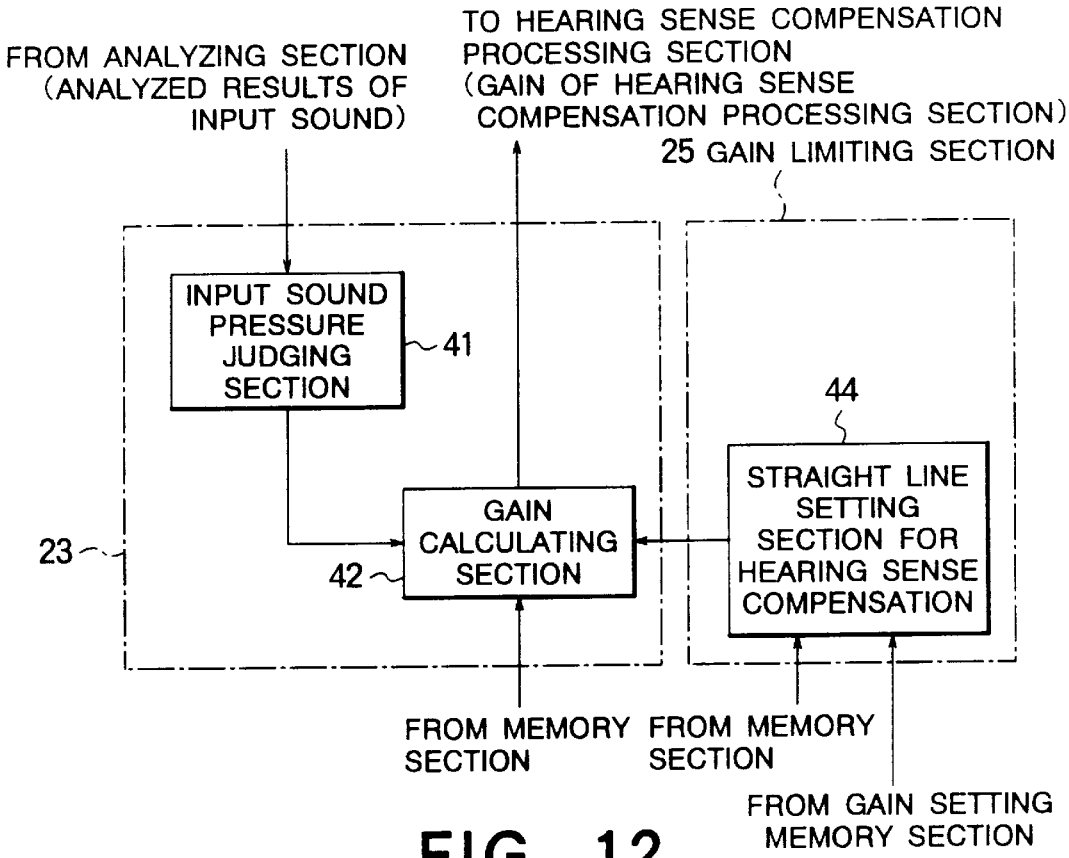
FIG. 11 is a block diagram of a hearing aid in accordance with the second embodiment of the present invention.

A hearing aid in accordance with the second embodiment of the present invention will next be explained by using FIG. 11. This hearing aid in the second embodiment is used in the hearing sense compensating method in the second embodiment. A gain used in the hearing sense compensation processing is determined in the control section 23 and the gain limiting section 25 in the block diagram of the hearing aid shown in FIG. 5. FIG. 11 shows a block diagram of this control section 23 and the gain limiting section 25. A basic operation of the hearing aid is the same as the second embodiment of the present invention. The basic operation differs from that in the second embodiment in that the curve setting section 43 for hearing sense compensation processing in FIG. 8 is replaced with a straight line setting section 44 for hearing sense compensation processing. In the straight line setting section 44 for hearing sense compensation processing, a function approximating the original loudness curve of the hearing impairment person is set to a straight line having a reduced inclination at a sound pressure equal to or smaller than the sound pressure c" for starting the reduction in gain on the basis of hearing ability characteristics of a normal hearing person and a user, data of the sound pressure c" for starting the reduction in gain, and data of the sound pressure L providing a gain equal to or greater than 0 dB. The hearing ability characteristics and these sound pressure data are sent from the memory section. In the straight line section 44, functions approximating the loudness curves of the normal hearing person and the hearing impairment person are calculated. The calculated results are sent to a gain calculating section 42. Thus, in addition to the second embodiment, the gain with respect to small noises in non-voice portions before and after the input sound can be reduced by a smaller calculating amount.

Figure 12:
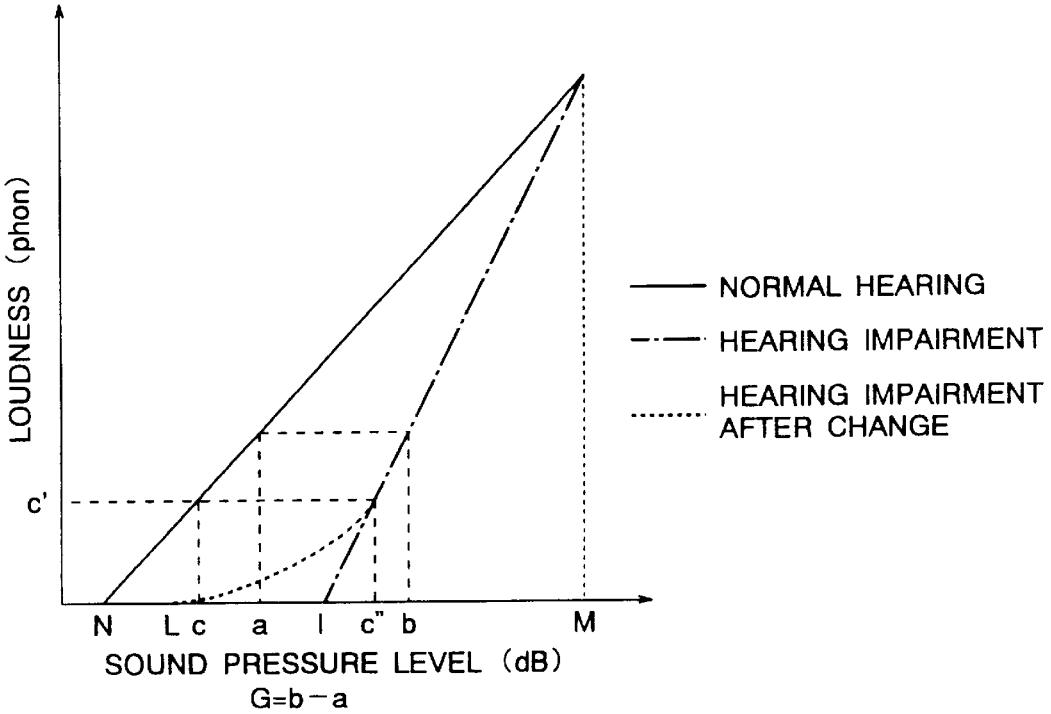
FIG. 12 is a graph of a loudness curve in a third embodiment of the present invention.

A hearing sense compensation processing method in a third embodiment of the present invention will next be explained by using FIGS. 12 and 13. In this method, as shown in FIG. 12, a function approximating the loudness curve of the hearing impairment person at a sound pressure equal to or smaller than the sound pressure c" for starting the reduction in gain in the processing method in the first embodiment is modified by using a downward convex curve to change the gain with respect to the input sound at a sound pressure equal to or smaller than the sound pressure c" so that this gain is reduced. The sound pressure L providing a gain equal to or greater than 0 dB and set to the gain setting memory section in advance is set at a terminal end of the downward convex curve. In the case of a sound pressure equal to or smaller than the sound pressure c", the gain is calculated from a function approximating the loudness curve of the normal hearing person represented by the formula (2) and a downward convex quadratic curve represented by the following formula (6). In contrast to this, in the case of a sound pressure equal to or greater than the sound pressure c", similar to the first embodiment of the present invention, the gain is calculated from the function approximating the loudness curve of the normal hearing person represented by the formula (2) and a function approximating the loudness curve of the hearing impairment person represented by the formula (3).

$$Yid=Aid\times Xid2+Bid\times Xid+Cid \quad (6)$$

At this time, c'=Aid×c"2+Bid×c"+Cid, and Aid>0 are set.

Figure 13:
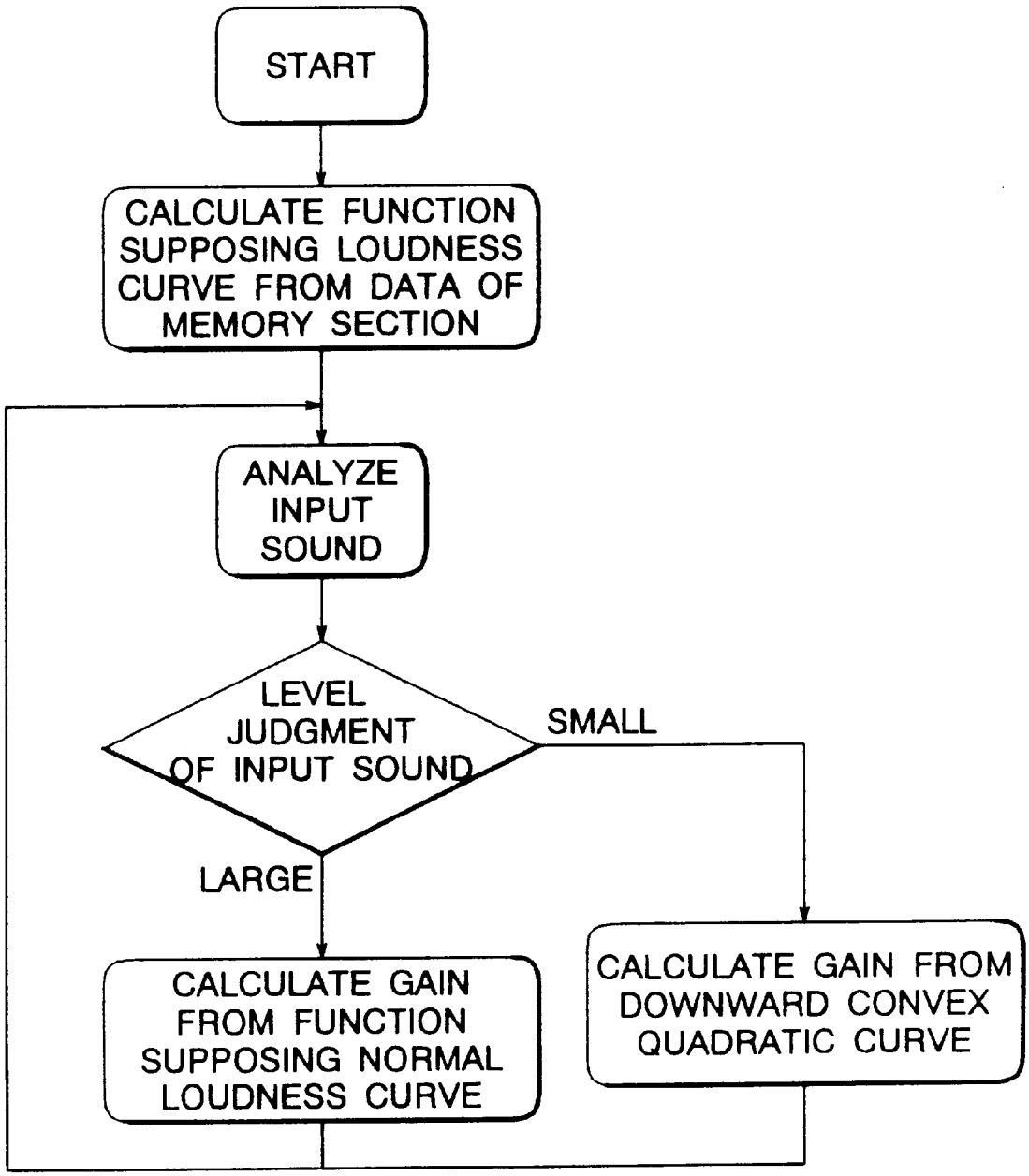
FIG. 13 is a flow chart of processing in the third embodiment of the present invention.

As can be seen from FIG. 13, after a level judgment of the input sound is made, the gain is calculated from the downward convex quadratic curve when the input sound is small in comparison with a comparing value.

In this hearing sense compensation processing method in the third embodiment, since the quadratic curve is used to calculate the gain, a calculating amount is increased in comparison with the processing method in the second embodiment. However, in addition to the hearing sense compensation processing methods in the first and second embodiments, the gain with respect to the input sound at a small sound pressure can be very reduced in comparison with an input sound at a sound pressure equal to or smaller than a preset sound pressure, particularly, a set sound pressure. Further, it is possible to smooth changing characteristics of the gain with respect to the input sound at a sound pressure level close to the above set sound pressure. Therefore, an abnormal sound sensed by suddenly changing the gain can be restrained.

Figure 14:
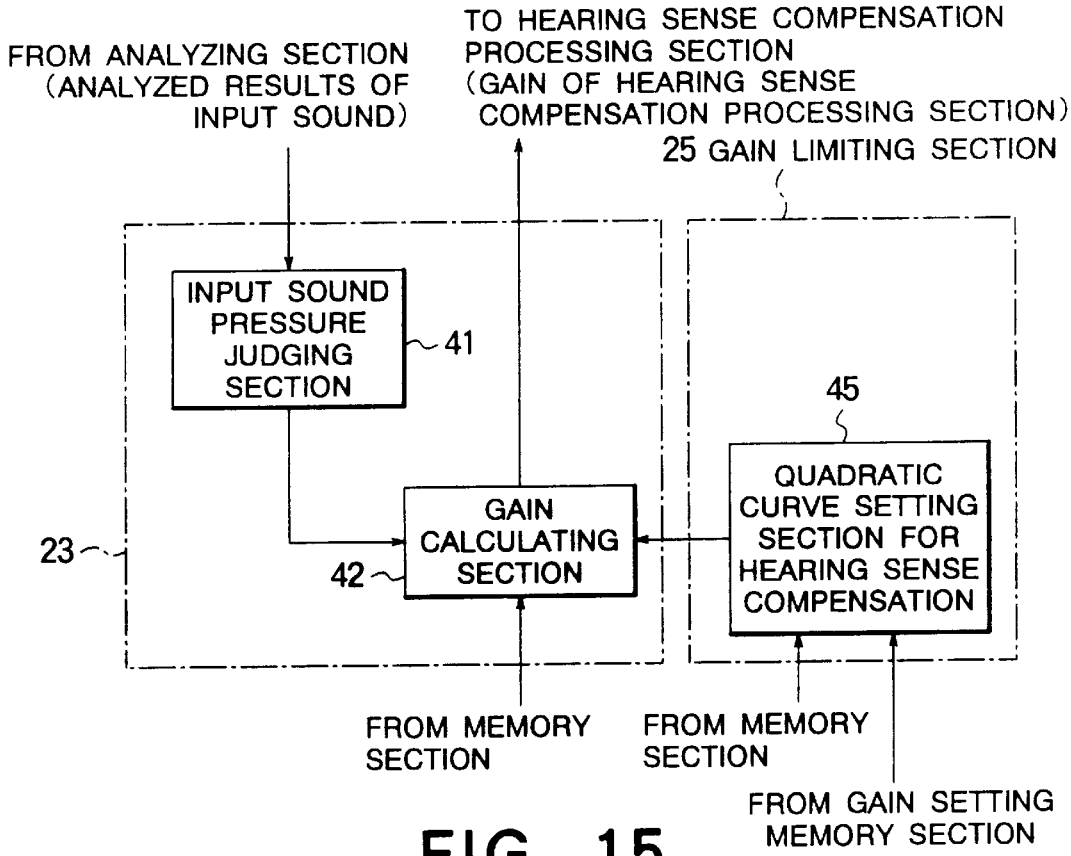
FIG. 14 is a block diagram of a hearing aid in accordance with each of the third embodiment and a fourth embodiment of the present invention.

A hearing aid in accordance with a third embodiment of the present invention will next be explained by using FIG. 14. The hearing aid in this third embodiment is used in the hearing sense compensating method in the third embodiment. A gain used in the hearing sense compensation processing is determined in the control section 23 and the gain limiting section 25 in the block diagram of the hearing aid shown in FIG. 5. FIG. 14 shows a block diagram of this control section 23 and the gain limiting section 25. A basic operation of the hearing aid is the same as the hearing aid in the first embodiment. The basic operation differs from that of the hearing aid in the first embodiment in that the curve setting section 43 for hearing sense compensation processing in FIG. 8 is replaced with a quadratic curve setting section 45 for hearing sense compensation processing. In the quadratic curve setting section 45 for hearing sense compensation processing, a downward convex quadratic curve on a function approximating the loudness curve is calculated on the basis of hearing ability characteristics of a normal hearing person and a user sent from the memory section, data of the sound pressure c" for starting the reduction in gain, and data of the sound pressure L for setting the gain to be equal to or greater than 0 dB. The calculated results are sent to a gain calculating section 42.

Thus, in the hearing aid in the third embodiment, in addition to the hearing aid in each of the first and second embodiments, it is possible to very reduce the gain with respect to an input sound at a small sound pressure in comparison with the input sound at a sound pressure equal to or smaller than a preset sound pressure, particularly, a set sound pressure. Further, changing characteristics of the gain with respect to the input sound at a sound pressure level close to the above set sound pressure can be smoothed. Therefore, it is possible to restrain an abnormal sound sensed by suddenly changing the gain.

Figure 15:
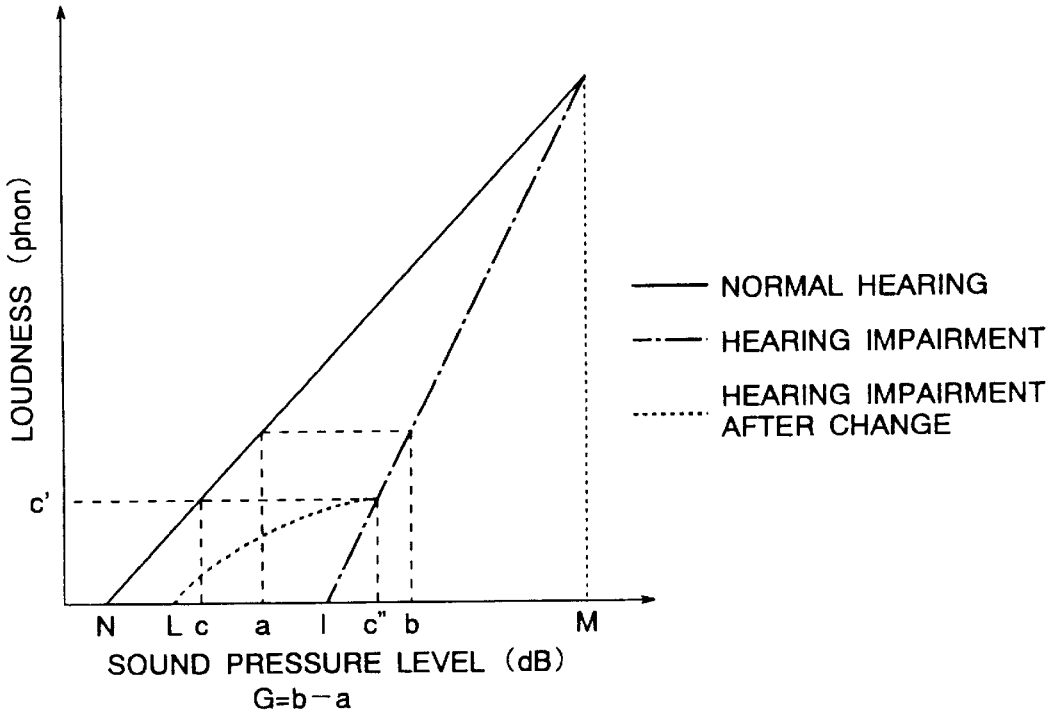
FIG. 15 is a graph of a loudness curve in the fourth embodiment of the present invention.

A hearing sense compensation processing method in a fourth embodiment will next be explained by using FIGS. 15 and 16. In this method in the fourth embodiment, a function approximating the loudness curve of the hearing impairment person at a sound pressure equal to or smaller than the sound pressure c" for starting the reduction in gain as shown in FIG. 15 in the processing method in the first embodiment is modified by using an upward convex curve so that the gain with respect to the input sound at a sound pressure equal to or smaller than the sound pressure c" is reduced.

The sound pressure L providing a gain equal to or greater than 0 dB and set to the gain setting memory section in advance is set at a terminal end of the upward convex curve. In the case of a sound pressure equal to or smaller than the sound pressure c", the gain is calculated from a function approximating the loudness curve of the normal hearing person represented by the formula (2) and an upward convex quadratic curve represented by the following formula (7). In contrast to this, in the case of a sound pressure equal to or greater than the sound pressure c", similar to the first embodiment of the present invention, the gain is calculated from the function approximating the loudness curve of the normal hearing person represented by the formula (2) and a function approximating the loudness curve of the hearing impairment person represented by the formula (3).

$$Yiu=Aiu\times Xiu2+Biu\times Xiu+Ciu \quad (7)$$

At this time, c'=Aiu×c"2+Biu×c"+Ciu, and Aiu <0 are set.

Figure 16:
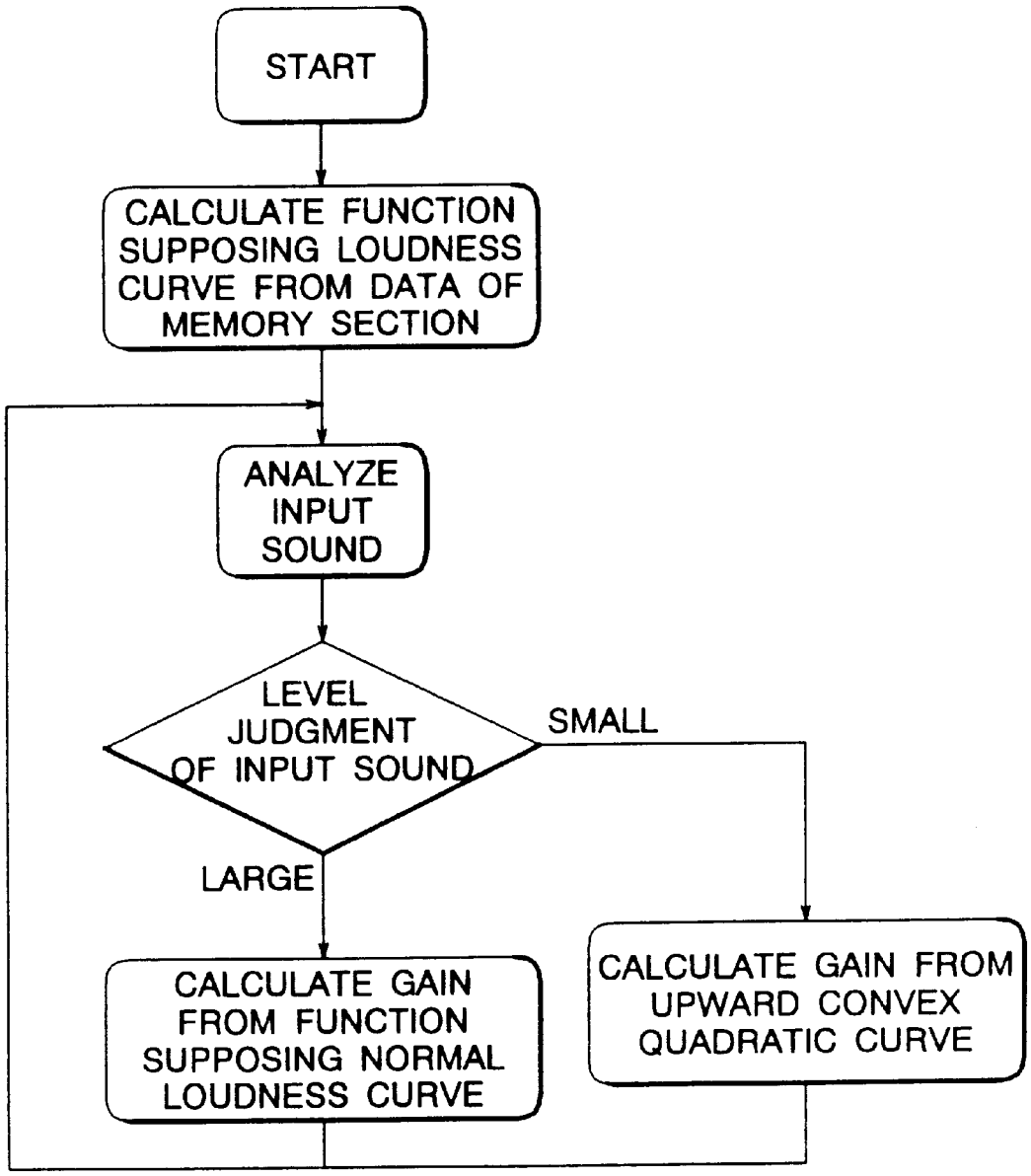
FIG. 16 is a flow chart of processing in the fourth embodiment of the present invention.

As can be seen from FIG. 16, after a level judgment of the input sound is made, the gain is calculated from the upward convex quadratic curve when the input sound is small in comparison with a comparing value.

In the hearing sense compensation processing method in the fourth embodiment, similar to the processing method in the third embodiment, the quadratic curve is used to calculate the gain so that a calculating amount is increased in comparison with the processing method in the third embodiment. Further, the changing characteristics of the gain with respect to the input sound at a sound pressure level close to the sound pressure c" for starting the above reduction in gain are suddenly changed. However, the gain with respect to the input sound at a sound pressure equal to or smaller than a preset sound pressure can be very reduced in addition to the processing methods in the first, second and third embodiments.

A hearing aid in the fourth embodiment of the present invention will next be explained by again using FIG. 14.

This hearing aid in the fourth embodiment is used in the hearing sense compensating method in the fourth embodiment. Therefore, the graph of a function approximating a loudness curve showing a calculating method of the gain is shown in FIG. 15 and is different from the graph shown in FIG. 12.

The gain used in the hearing sense compensation processing is determined in the control section 23 and the gain limiting section 25 in the block diagram of the hearing aid shown in FIG. 5. FIG. 14 shows a block diagram of this control section 23 and the gain limiting section 25. A basic operation of the hearing aid is the same as the hearing aid in the first embodiment. The basic operation differs from that of the hearing aid in the first embodiment in that the curve setting section 43 for hearing sense compensation processing in FIG. 8 is replaced with a quadratic curve setting section 45 for hearing sense compensation processing. In the quadratic curve setting section 45 for hearing sense compensation processing, an upward convex quadratic curve on a function approximating the loudness curve is calculated on the basis of hearing ability characteristics of a normal hearing person and a user sent from the memory section, and data of the sound pressure c" for starting the reduction in gain. The calculated results are sent to a gain calculating section 42. Thus, the gain with respect to the input sound at a sound pressure equal to or smaller than a preset sound pressure can be very reduced in addition to each of the hearing aids in the first, second and third embodiments.

Figure 17:
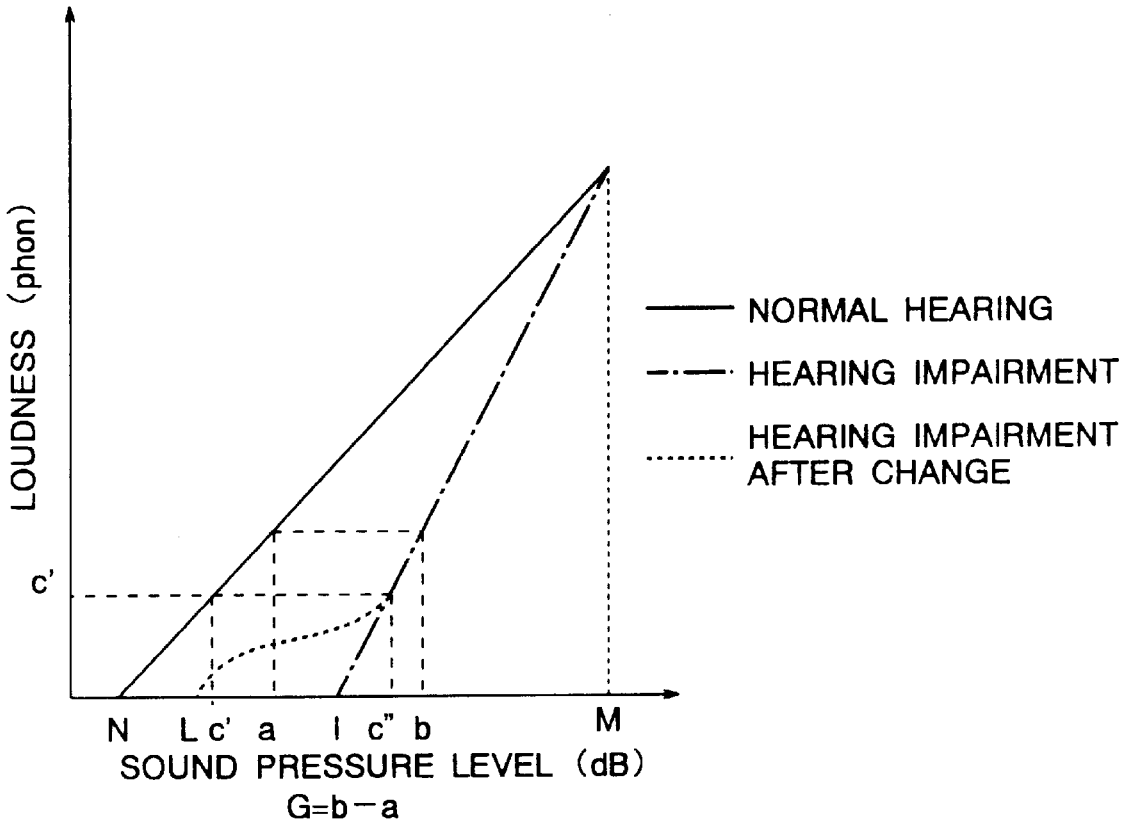
FIG. 17 is a graph of a loudness curve in a fifth embodiment of the present invention.

A hearing sense compensation processing method in a fifth embodiment of the present invention will next be explained by using FIGS. 17 and 18. In this method, as shown in FIG. 17, a function approximating the loudness curve of the hearing impairment person at a sound pressure equal to or smaller than the sound pressure c" for starting the reduction in gain in the processing method in the third embodiment is modified by using a downward convex curve and an upward convex curve so as to reduce the gain with respect to the input sound at a sound pressure equal to or smaller than the sound pressure c". The sound pressure L providing a gain equal to or greater than 0 dB and set to the gain setting memory section in advance is set at terminal ends of the upward and downward convex curves. In the case of a sound pressure equal to or smaller than the sound pressure c", the gain is calculated from a function approximating the loudness curve of the normal hearing person represented by the formula (2) and an upward downward convex cubical curve straight line represented by the following formula (8). In contrast to this, in the case of a sound pressure equal to or greater than the sound pressure c", similar to the first embodiment of the present invention, the gain is calculated from the function approximating the loudness curve of the normal hearing person represented by the formula (2) and a function approximating the loudness curve of the hearing impairment person represented by the formula (3).

$$Yiud=Aiud\times Xiud3+Biud\times Xiud2+Ciud\times Xiud+Diud \quad (8)$$

At this time, c'=Aiud×c"3+Biud×c"2+Diud is set.

Figure 18:
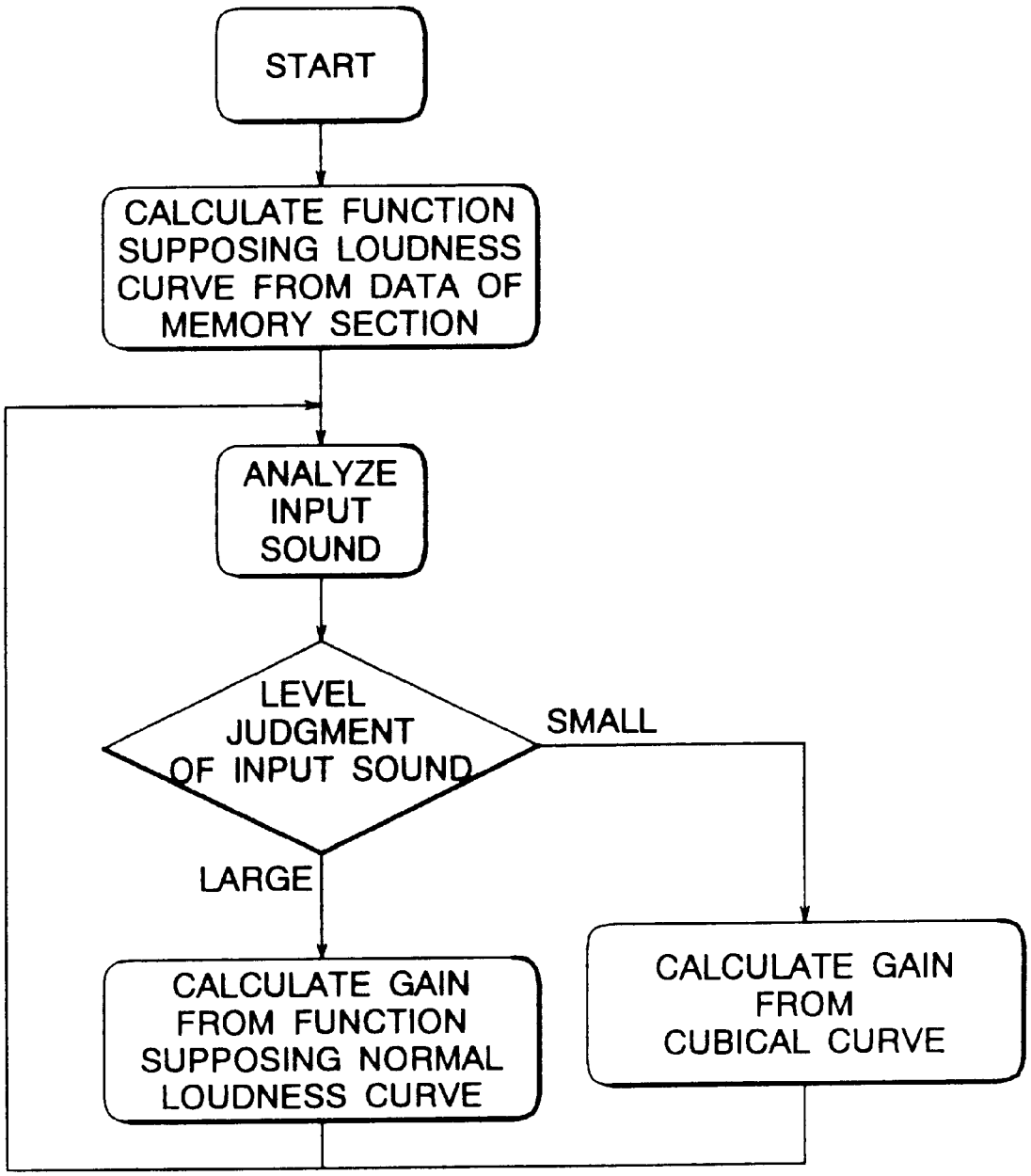
FIG. 18 is a flow chart of processing in the fifth embodiment of the present invention.

As can be seen from FIG. 18, after a level judgment of the input sound is made, the gain is calculated from the cubical curve when the input sound is small in comparison with a comparing value.

In this hearing sense compensation processing method in the fifth embodiment, since the cubical curve is used to calculate the gain, a calculating amount is increased in comparison with the processing methods in the second, third and fourth embodiments. However, in addition to the hearing sense compensation processing methods in the first, second, third and fourth embodiments, the gain with respect to the input sound at a sound pressure equal to or smaller than a preset sound pressure can be very reduced. Further, it is possible to smooth changing characteristics of the gain with respect to the input sound at a sound pressure level close to the above set value. Therefore, an abnormal sound sensed by suddenly changing the gain can be restrained.

Figure 19:
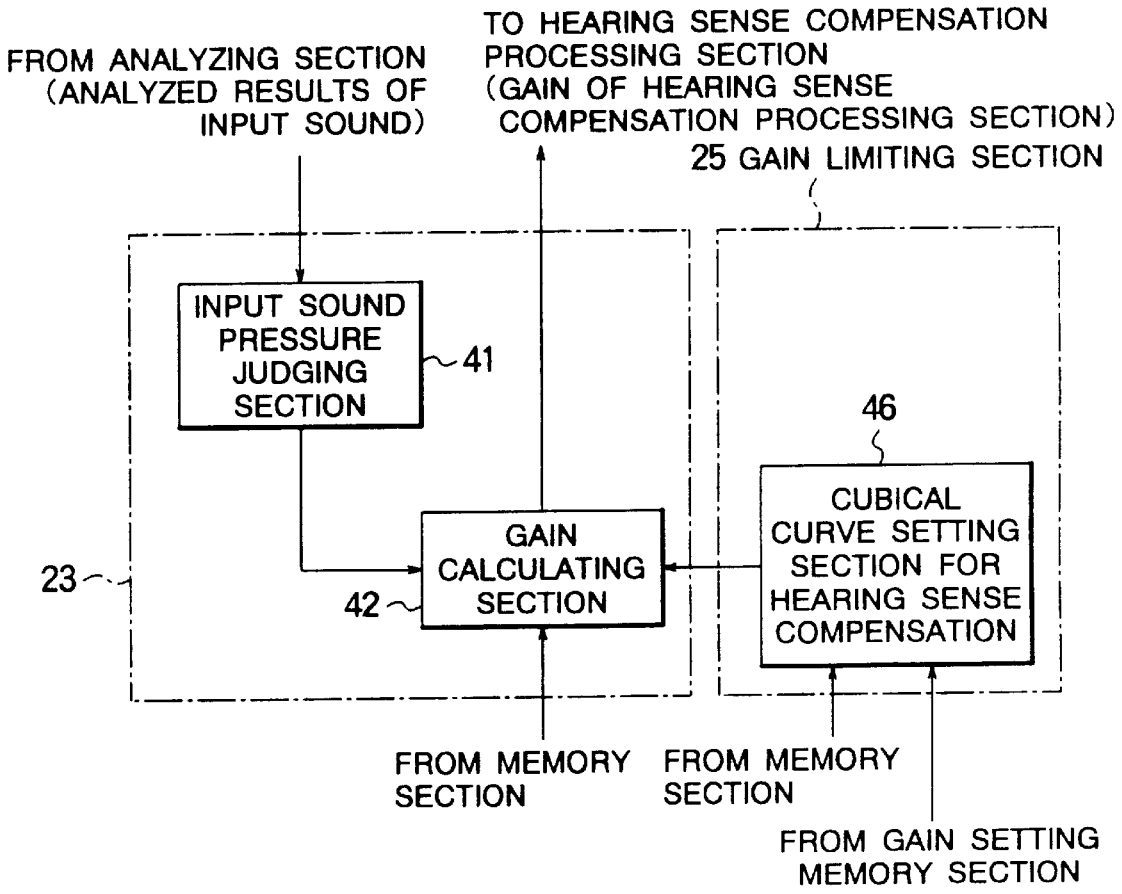
FIG. 19 is a block diagram of a hearing aid in accordance with the fifth embodiment of the present invention.

A hearing aid in accordance with a fifth embodiment of the present invention will next be explained by using FIG. 19. The hearing aid in the fifth embodiment is used in the hearing sense compensating method in the fifth embodiment. A gain used in the hearing sense compensation processing is determined in the control section 23 and the gain limiting section 25 in the block diagram of the hearing aid shown in FIG. 5. FIG. 19 shows a block diagram of this control section 23 and the gain limiting section 25. A basic operation of the hearing aid is the same as the hearing aid in the first embodiment. The basic operation differs from that of the hearing aid in the first embodiment in that the curve setting section 43 for hearing sense compensation processing in FIG. 8 is replaced with a cubical curve setting section 46 for hearing sense compensation processing. In the cubical curve setting section 46 for hearing sense compensation processing, a function approximating the loudness curve of the hearing impairment person is changed in accordance with a downward convex quadratic curve on the function approximating the loudness curve near a sound pressure for starting the change in gain on the basis of hearing ability characteristics of a normal hearing person and a user sent from the memory section, and data of the sound pressure for starting the reduction in gain. The function approximating the loudness curve of the hearing impairment person is changed in accordance with an upward convex quadratic curve on the function approximating the loudness curve at a sound pressure sufficiently small in comparison with the sound pressure for starting the change in gain. Next, the gain with respect to the input sound is calculated from the function approximating the loudness curve of the normal hearing person and the function approximating a modified loudness curve of the hearing impairment person. The calculated results are sent to a gain calculating section 42. Thus, the gain with respect to the input sound at a sound pressure equal to or smaller than a preset sound pressure can be very reduced in addition to each of the hearing aids in the first, second and third embodiments. Further, it is possible to smooth changing characteristics of the gain with respect to the input sound at a sound pressure level close to the above set value. Therefore, an abnormal sound sensed by suddenly changing the gain can be restrained.

Figure 20:
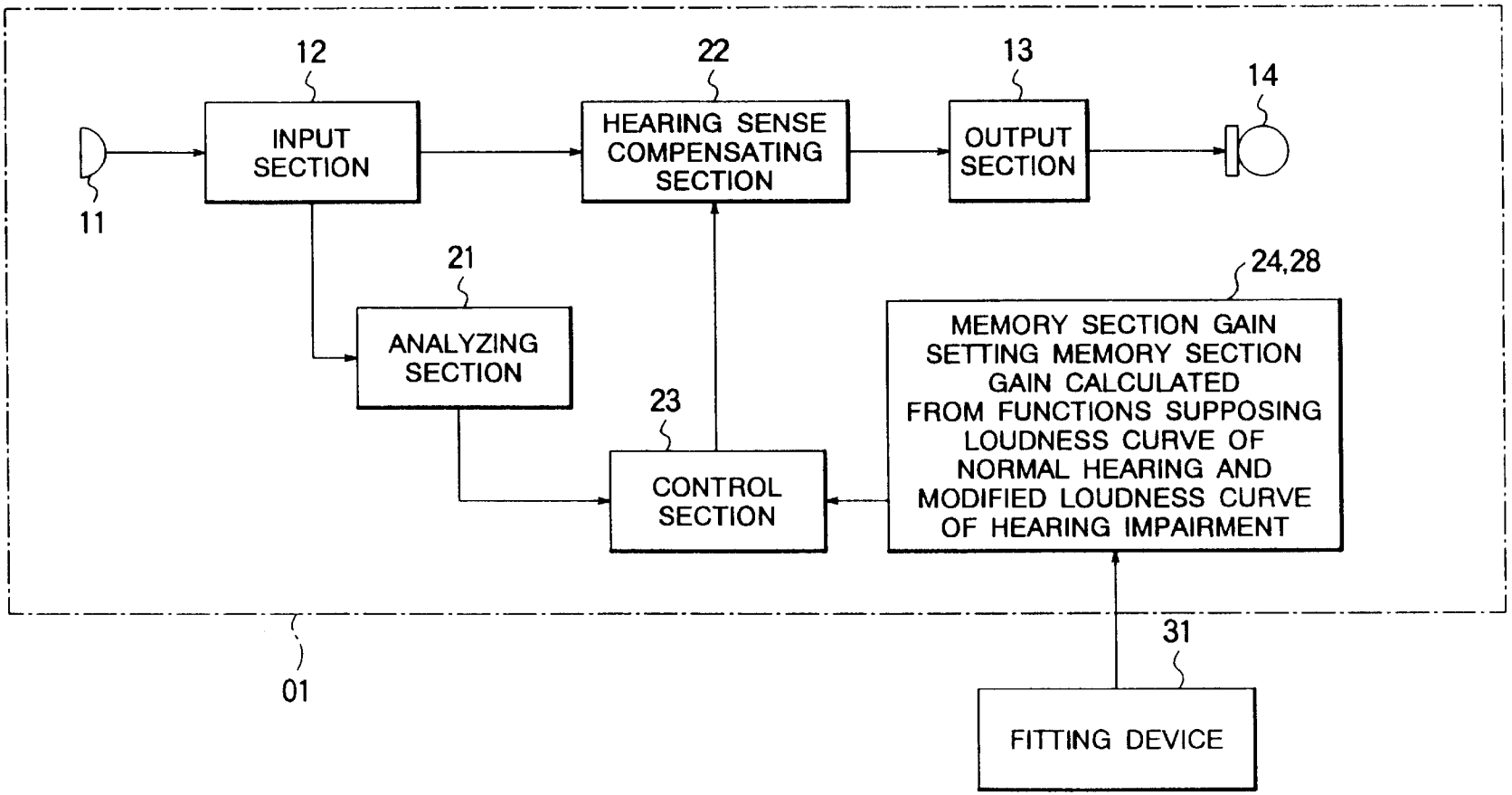
FIG. 20 is a block diagram of a hearing aid in accordance with a sixth embodiment of the present invention.

A hearing aid in accordance with a sixth embodiment of the present invention will next be explained by using FIG. 20. The hearing aid in the sixth embodiment is characterized in that a modifying work of the function approximating the loudness curve of the hearing impairment person made within the gain limiting section 25 of FIG. 5 is made at a fitting time as shown in FIG. 20 and all required data are held in the memory section 24 in each of the hearing aids in the first, second, third, fourth and fifth embodiments. Therefore, as can be seen from FIG. 20, no gain limiting section 25 is required. A basic operation of the hearing aid is the same as the second embodiment of the present invention. An operation of the hearing aid relative to a modifying portion of the function approximating the loudness curve will next be explained by using FIG. 20. Gain data are stored to the memory section 24 and a gain setting memory section 28 in advance at the fitting time. In these gain data, the analyzed results of an input sound and functions approximating the loudness curve of the normal hearing person and a modified loudness curve of the hearing impairment person are calculated. Therefore, if the analyzed results of the input sound show a specific address, the gain data with respect to each input sound can be taken out. The control section 23 obtaining the analyzed results of the input sound from an analyzing section 21 directly sets the analyzed results to addresses of the memory section 24 and the gain setting memory section 28, or sets coded or decoded contents of the analyzed results to addresses of the memory section 24 and the gain setting memory section 28. The control section 23 then sends these results to the memory section 24 and the gain setting memory section 28. As a result, the memory section 24 and the gain setting memory section 28 can send a gain stored in advance to the control section 23. Thus, data of a function approximating a newly calculated loudness curve are sent to the control section 23. A calculating amount of the control section 23 and an entire calculating amount of the hearing aid can be greatly reduced by using this technique.

Figure 21A:
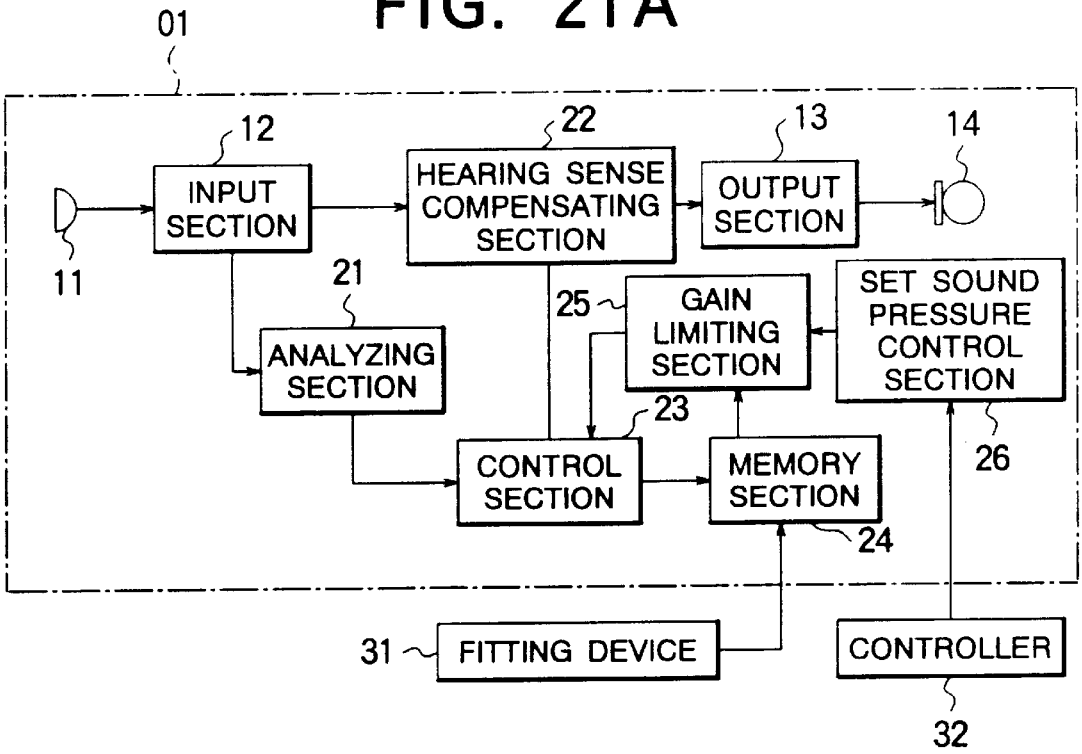
FIGS. 21A and 21B are diagrams relating to a hearing aid in accordance with a seventh embodiment of the present invention.
Figure 21B:
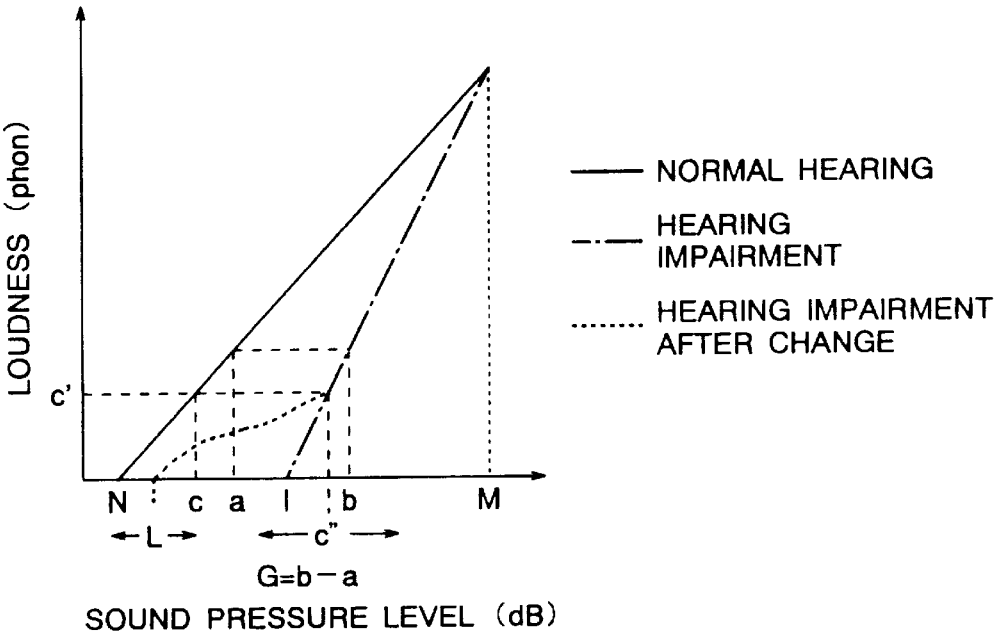

A hearing aid in a seventh embodiment of the present invention will next be explained by using FIG. 21. The hearing aid in the seventh embodiment has a set sound pressure control section 26 and a controller 32 as shown in FIG. 21A in the hearing aid in each of the first, second, third, fourth and fifth embodiments. A basic operation of the hearing aid is the same as the hearing aid in the first embodiment. Here, a user adjusts a sound pressure c" for starting the reduction in gain, a sound pressure L for setting the gain to be equal to or greater than 0 dB, and changing characteristics of a gain with respect to a small sound pressure by using the controller 32. Therefore, no gain setting memory section 28 is required as shown in FIG. 21A. The set sound pressure control section 26 sends the sound pressure c" for starting the reduction in gain, the sound pressure L for setting the gain to be equal to or greater than 0 dB, and data of the changing characteristics of the gain set by the user to the gain limiting section 25. Similar to the first, second, third, fourth and fifth embodiments, the gain limiting section 25 modifies the function approximating the loudness curve of the user as shown in FIG. 21B on the basis of the sent data, and can reduce the gain with respect to an input sound at a sound pressure equal to or smaller than the above set sound pressure. Thus, in the hearing aid in the seventh embodiment, the user can control the data of the changing characteristics of the gain by a controller of a volume, etc. in addition to the hearing aid in each of the first to fifth embodiments. Accordingly, the input sound can be set in an auditory area of the user even in an environment in which sound pressures of the input sound are different from each other.

Figure 22A:
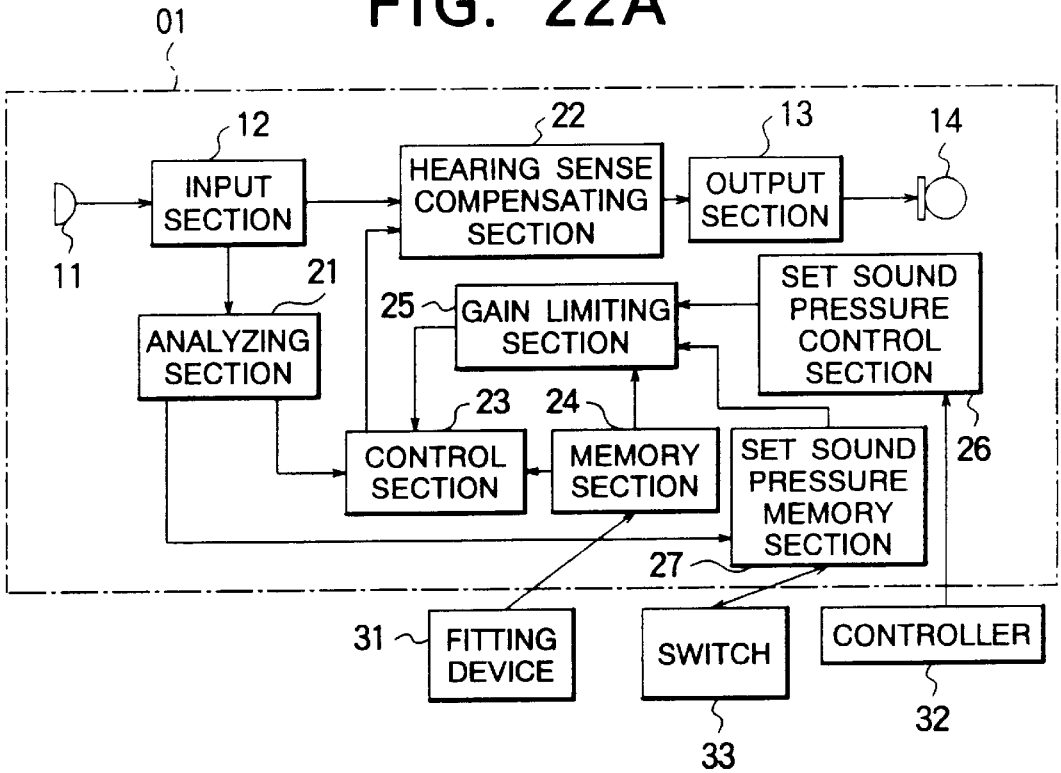
FIGS. 22A and 22B are diagrams relating to a hearing aid in accordance with an eighth embodiment of the present invention.
Figure 22B:
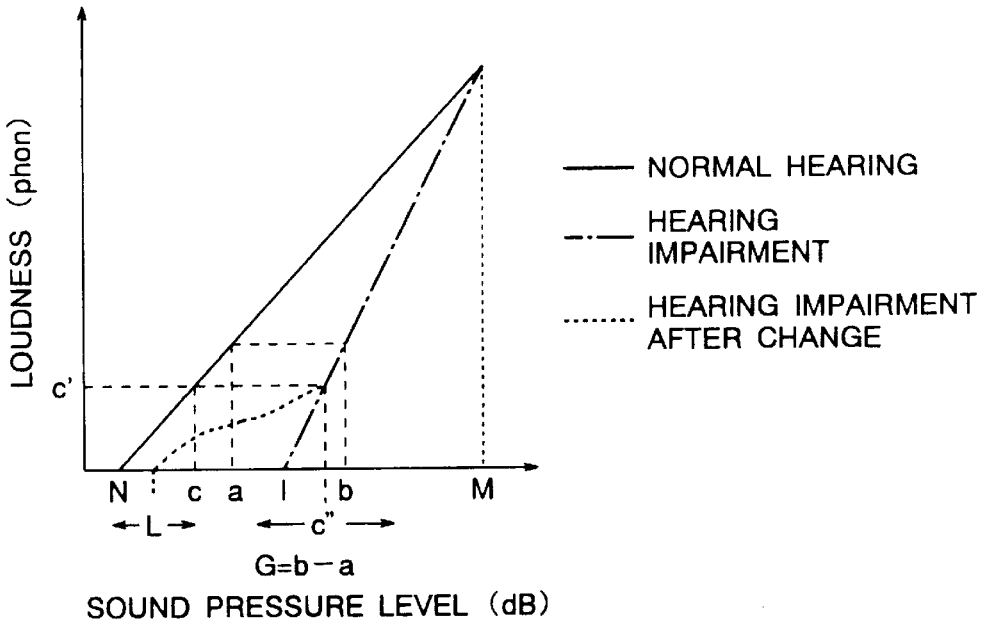

A hearing aid in an eighth embodiment of the present invention will next be explained by using FIG. 22. The hearing aid in the eighth embodiment has a set sound pressure memory section 27 and a switch 33 as shown in FIG. 22 in the first to fifth and seventh embodiments. A basic operation of the hearing aid is the same as the hearing aid in the first embodiment. Here, a user sets a sound pressure c" for starting the reduction in gain, a sound pressure L for setting the gain to be equal to or greater than 0 dB, and changing characteristics of a gain with respect to a small sound pressure by using the switch 33. Therefore, no gain setting memory section 28 is required. There is no sound to be heard by the user at a setting time, and a circumferential environmental sound at that time is set to a reference. The set sound pressure memory section 27 stores the analyzed results of an input sound when the switch 33 is pushed by the user. Further, similar to the first to fifth and seventh embodiments, a function approximating a loudness curve of the user is modified by using the analyzed results and the gain with respect to an input sound at a sound pressure equal to or smaller than the above set sound pressure can be reduced. Thus, the processed data are sent to the control section 23 in the case of the first to fifth embodiments and are sent to the gain limiting section 25 in the case of the seventh and eighth embodiments. Similar to the first to fifth and seventh embodiments, the control section 23 or the gain limiting section 25 modifies the function approximating the loudness curve of the user on the basis of the sent data so that the gain with respect to the input sound at a sound pressure equal to or smaller than the above set sound pressure can be reduced. Thus, in the hearing aid in the eighth embodiment, the user can control the sound pressure for starting the reduction in gain from a circumferential environmental sound by the switch, etc. in addition to the first to fifth and seventh embodiments so that circumferential noises can be effectively removed.

What is claimed is:

1. A digital hearing aid comprises:

a hearing sense compensation processing section of a dynamic range compression type for determining a gain every frequency band by using a sound pressure level of an input sound and hearing ability characteristics of a user, the hearing sense compensation processing section gradually reducing the gain with respect to the input sound at a sound pressure equal to or smaller than a preset sound pressure by using loudness curves of a normal hearing person and the user in accordance with the sound pressure of the input sound.

2. The digital hearing aid according to claim 1, wherein the gain with respect to the input sound is gradually reduced by connecting a loudness level of the user equal to a loudness level sensed by the normal hearing person to a set value between minimum hearable values of the normal hearing person and the user by an upward convex curve with respect to a signal at a sound pressure equal to or smaller than a set sound pressure.

3. The digital hearing aid according to claim 2, wherein a reduced portion of the gain with respect to the input sound is smoothly connected by a downward convex curve so as to smooth the change in gain.

4. The digital hearing aid according to claim 3, wherein the digital hearing aid has a set sound pressure control section for restraining a sound pressure for starting the reduction in gain and a sound pressure for setting the gain to be equal to or greater than 0 dB, and the user can control said sound pressure level by a controller of a volume, etc.

5. The digital hearing aid according to claim 3, wherein the digital hearing aid has a set sound pressure memory section and, when there is no input sound to be heard by the user, the sound pressure level of the input sound at that time is stored to said set sound pressure memory section by pushing a switch, etc., and a sound pressure level set by a gain control section is controlled on the basis of a value of the sound pressure level of the input sound.

6. The digital hearing aid according to claim 2, wherein the digital hearing aid has a set sound pressure control section for controlling a sound pressure for starting the reduction in gain and a sound pressure for setting the gain to be equal to or greater than 0 dB, wherein the user can control said sound pressure level by a controller of a volume, etc.

7. The digital hearing aid according to claim 2, wherein the digital hearing aid has a set sound pressure control section for restraining a sound pressure for starting the reduction in gain and a sound pressure for setting the gain to be equal to or greater than 0 dB, and the user can control said sound pressure level by a controller of a volume, etc.

8. The digital hearing aid according to claim 2, wherein the digital hearing aid has a set sound pressure memory section and, when there is no input sound to be heard by the user, the sound pressure level of the input sound at that time is stored to said set sound pressure memory section by pushing a switch, etc., and a sound pressure level set by a gain control section is controlled on the basis of a value of the sound pressure level of the input sound.

9. The digital hearing aid according to claim 1, wherein the digital hearing aid has a set sound pressure control section for controlling a sound pressure for starting the reduction in gain and a sound pressure for setting the gain to be equal to or greater than 0 dB, wherein the user can control said sound pressure level by a controller of a volume, etc.

10. The digital hearing aid according to claim 1, wherein the digital hearing aid has a set sound pressure control section for restraining a sound pressure for starting the reduction in gain and a sound pressure for setting the gain to be equal to or greater than 0 dB, and the user can control said sound pressure level by a controller of a volume, etc.

11. The digital hearing aid according to claim 1, wherein the digital hearing aid has a set sound pressure memory section and, when there is no input sound to be heard by the user, the sound pressure level of the input sound at that time is stored to said set sound pressure memory section by pushing a switch, etc., and a sound pressure level set by a gain control section is controlled on the basis of a value of the sound pressure level of the input sound.

12. A hearing sense compensation processing method of a dynamic range compression type comprises a step of determining a gain of every frequency band by using a sound pressure level of an input sound and hearing ability characteristics of a user, in the step, the gain with respect to the input sound at a sound pressure equal to or smaller than a preset sound pressure being gradually reduced by using loudness curves of a normal hearing person and the user in accordance with the sound pressure of the input sound.

13. The hearing sense compensation processing method according to claim 12, wherein the gain with respect to the input sound is gradually reduced by connecting a loudness level of the user equal to a loudness level sensed by the normal hearing person to a set value between minimum hearable values of the normal hearing person and the user by an upward convex curve with respect to a signal at a sound pressure equal to or smaller than a set sound pressure.

14. The hearing sense compensation processing method according to claim 12, wherein a reduced portion of the gain with respect to the input sound is smoothly connected by a downward convex curve so as to smooth the change in gain.

* * * * *